US008113913B2

(12) United States Patent
Pietsch et al.

(10) Patent No.: US 8,113,913 B2
(45) Date of Patent: Feb. 14, 2012

(54) METHOD FOR THE SIMULTANEOUS GRINDING OF A PLURALITY OF SEMICONDUCTOR WAFERS

(75) Inventors: Georg Pietsch, Burghausen (DE); Michael Kerstan, Burghausen (DE); Heiko aus dem Spring, Hamburg (DE)

(73) Assignees: Siltronic AG, Munich (DE); Peter Wolters GmbH, Rendsburg (DE)

( * ) Notice: Subject to any disclaimer, the term of this patent is extended or adjusted under 35 U.S.C. 154(b) by 1006 days.

(21) Appl. No.: 12/048,267

(22) Filed: Mar. 14, 2008

(65) Prior Publication Data

US 2008/0233840 A1 Sep. 25, 2008

(30) Foreign Application Priority Data

Mar. 19, 2007 (DE) ..... 10 2007 013 058

(51) Int. Cl.
*B24B 49/00* (2006.01)

(52) U.S. Cl. ..... 451/7; 451/9; 451/10; 451/11; 451/261; 451/268; 451/288; 451/488

(58) Field of Classification Search ..... 451/7, 8, 451/9, 10, 11, 261, 262, 268, 269, 272, 285, 451/287, 288, 449, 488
See application file for complete search history.

(56) References Cited

U.S. PATENT DOCUMENTS

| | | | | |
|---|---|---|---|---|
| 4,621,458 | A | 11/1986 | Smith | |
| 4,665,658 | A | 5/1987 | Carcey | |
| 4,739,589 | A | 4/1988 | Brehm et al. | |
| 6,007,407 | A | 12/1999 | Rutherford et al. | |
| 6,299,514 | B1 | 10/2001 | Boller | |
| 6,419,555 | B1 | 7/2002 | Goers | |
| 7,101,258 | B2 * | 9/2006 | Ising | 451/7 |
| 7,601,049 | B2 * | 10/2009 | Bhagavat et al. | 451/9 |
| 7,662,023 | B2 * | 2/2010 | Vandamme et al. | 451/9 |
| 7,815,489 | B2 * | 10/2010 | Pietsch et al. | 451/7 |
| 7,927,185 | B2 * | 4/2011 | Vandamme et al. | 451/9 |

(Continued)

FOREIGN PATENT DOCUMENTS

CN 1699018 A 11/2005

(Continued)

OTHER PUBLICATIONS

Derwent Abstract corresponding to DE 19954355 A1, AN 2001-617985.

(Continued)

*Primary Examiner* — Eileen P. Morgan
(74) *Attorney, Agent, or Firm* — Brooks Kushman P.C.

(57) ABSTRACT

Simultaneous double-side grinding of a plurality of semiconductor wafers involves positioning each wafer freely in a cutout of one of plural carriers which rotate on a cycloidal trajectory, wherein the wafers are machined between two rotating ring-shaped working disks, each disk having a working layer of bonded abrasive, wherein the form of the working gap between working layers is determined during grinding and the form of the working area of at least one disk is altered such that the gap has a predetermined form. The wafers, during machining, may temporarily overhang the gap. The carrier is optionally composed only of a first material, or is completely or partly coated with the first material such that during machining only the first material contacts the working layer, and the first material does not reduce the machining ability of the working layer.

29 Claims, 8 Drawing Sheets

U.S. PATENT DOCUMENTS

| | | | | |
|---|---|---|---|---|
| 7,930,058 | B2 * | 4/2011 | Bhagavat et al. | 700/164 |
| 2001/0047978 | A1 | 12/2001 | Wenski et al. | |
| 2003/0054650 | A1 * | 3/2003 | Wenski et al. | 438/692 |
| 2004/0235402 | A1 | 11/2004 | Bjelopavlic et al. | |
| 2005/0124264 | A1 | 6/2005 | Tominaga et al. | |
| 2005/0173377 | A1 * | 8/2005 | Pietsch et al. | 216/88 |
| 2005/0202757 | A1 * | 9/2005 | Junge et al. | 451/11 |
| 2005/0250426 | A1 | 11/2005 | Ferme | |
| 2006/0040589 | A1 * | 2/2006 | Ising | 451/8 |
| 2008/0014839 | A1 * | 1/2008 | Pietsch et al. | 451/41 |
| 2011/0101504 | A1 * | 5/2011 | Bhagavat et al. | 257/618 |

FOREIGN PATENT DOCUMENTS

| | | | |
|---|---|---|---|
| DE | 1 015 942 | | 9/1957 |
| DE | 10007390 | A1 | 10/2000 |
| DE | 19954355 | A1 | 5/2001 |
| DE | 19937784 | A1 | 2/2002 |
| DE | 10344602 | A1 | 5/2005 |
| DE | 102004040429 | A1 | 2/2006 |
| EP | 0208315 | B1 | 7/1986 |
| EP | 0 197 214 | A2 | 10/1986 |
| EP | 1 075 897 | B1 | 6/2000 |
| GB | 891409 | | 3/1962 |
| JP | 09262759 | A | 7/1997 |
| JP | 09248740 | A | 9/1997 |
| JP | 2000271857 | A | 10/2000 |
| JP | 2002231669 | A | 8/2002 |
| JP | 200377870 | A | 3/2003 |
| JP | 2004114277 | A | 4/2004 |
| JP | 2006100786 | A | 4/2006 |
| JP | 2007083337 | A | 4/2007 |
| JP | 200818528 | A | 1/2008 |
| KR | 2001104243 | | 11/2001 |

OTHER PUBLICATIONS

Derwent Abstract corresponding to EP 1075897 A1, AN 2001-161199.

Derwent Abstract corresponding to DE 10344602, AN 2005-387575.

English Abstract corresponding to EP 1 075 897.

* cited by examiner

METHOD FOR THE SIMULTANEOUS GRINDING OF A PLURALITY OF SEMICONDUCTOR WAFERS

BACKGROUND OF THE INVENTION

1. Field of the Invention

The present invention relates to a method for the simultaneous double-side grinding of a plurality of semiconductor wafers, wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating ring-shaped working disks, wherein each working disk comprises a working layer containing bonded abrasive.

2. Background Art

Electronics, microelectronics and microelectromechanics require as starting materials (substrates) semiconductor wafers with extreme requirements made of global and local flatness, single-side-referenced local flatness (nanotopology), roughness, cleanness and freedom from impurity atoms, in particular metals. Semiconductor wafers are wafers made of semiconductor materials. Semiconductor materials are compound semiconductors such as, for example, gallium arsenide or elemental semiconductors such as principally silicon and occasionally germanium or else layer structures thereof. Layer structures include for example a device-carrying silicon upper layer on an insulating interlayer ("silicon on insulator", SOI), or a lattice-strained silicon upper layer on a silicon/germanium interlayer with germanium proportion increasing toward the upper layer, on a silicon substrate ("strained silicon", s-Si), or combinations of the two ("strained silicon on insulator", sSOI).

Semiconductor materials are preferably used in monocrystalline form for electronic components or are preferably used in polycrystalline form for solar cells (photovoltaics).

In order to produce the semiconductor wafers, in accordance with the prior art, a semiconductor ingot is produced which is firstly separated into thin wafers, usually by means of a multiwire saw ("multiwire slicing", MWS). This is followed by one or more machining steps which can generally be classified into the following groups:

a) mechanical machining;
b) chemical machining;
c) chemomechanical machining;
d) if appropriate, production of layer structures.

The combination of the individual steps allotted to the groups and their order vary depending on the intended application. A multiplicity of secondary steps such as edge machining, cleaning, sorting, measuring, thermal treatment, packaging, etc. are furthermore used.

Mechanical machining steps in accordance with the prior art are lapping (simultaneous double-side lapping of a plurality of semiconductor wafers in the "batch"), single-side grinding of individual semiconductor wafers with single-side clamping of the workpieces (usually carried out as sequential double-side grinding; "single-side grinding", SSG; "sequential SSG") or simultaneous double-side grinding of individual semiconductor wafers between two grinding disks (simultaneous "double-disk grinding", DDG).

Chemical machining comprises etching steps such as alkaline, acidic or combination etch in a bath, if appropriate while moving semiconductor wafers and etching bath ("laminar-flow etch", LFE), single-side etching by applying etchant into the wafer center and radial spin-off by wafer rotation ("spin etch") or etching in the gas phase.

Chemomechanical machining comprises polishing methods in which a material removal is obtained by means of relative movement of semiconductor wafer and polishing cloth with the action of force and supply of a polishing slurry (for example alkaline silica sol). The prior art describes batch double-side polishing (DSP) and batch and individual wafer single-side polishing (mounting of the semiconductor wafers by means of vacuum, adhesive bonding or adhesion during the polishing machining on one side on a support).

The possibly concluding production of layer structures is effected by epitaxial deposition, usually from the gas phase, by oxidation, or by vapor deposition (for example metallization), etc.

For producing exceptionally planar semiconductor wafers, particular importance is ascribed to those machining steps in which the semiconductor wafers are machined largely in a constrained-force-free manner in "free-floating" fashion without force-locking or positively locking clamping ("free-floating processing" FFP). Undulations such as are produced for example by thermal drift or alternating load in MWS are eliminated by FFP particularly rapidly and with little loss of material. FFP known in the prior art include lapping, DDG and DSP.

It is particularly advantageous to use one or more FFP at the start of the machining sequence, that is to say usually by means of a mechanical FFP, since, by means of mechanical machining, the minimum required material removal for completely removing the undulations is effected particularly rapidly and economically and the disadvantages of the preferential etching of chemical or chemomechanical machining in the case of high material removals is avoided.

The FFP obtain the advantageous features described, however, only if the methods can be carried out in such a way that a largely uninterrupted machining is achieved from load to load in the same rhythm. This is because interruptions for possibly required setting, truing or dressing processes or frequently required tool changes lead to unpredictable "cold start" influences which nullify the desired features of the methods, and adversely affect the economic viability.

Lapping produces a very high damage depth and surface roughness on account of the brittle-erosive material removal as a result of the rolling movement of the loosely supplied lapping grain. This necessitates complicated subsequent machining for removing these damaged surface layers, whereby the advantages of lapping are nullified again. Moreover, as a result of depletion and loss of sharpness of the supplied grain during transport from the edge to the center of the semiconductor wafer, lapping always yields semiconductor wafers having a disadvantageously convex thickness profile with wafer edges of decreasing thickness ("edge roll-off" of the wafer thickness).

DDG causes, for kinematic reasons, in principle, a higher material removal in the center of the semiconductor wafer ("grinding navel") and, particularly in the case of a small grinding disk diameter, as is structurally preferred in the case of DDG, likewise an edge roll-off of the wafer thickness and also anisotropic—radially symmetrical—machining traces that strain the semiconductor wafer ("strain-induced warpage").

DE10344602A1 discloses a mechanical FFP method in which a plurality of semiconductor wafers lie in a respective cutout of one of a plurality of carriers that are caused to effect rotation by means of a ring-shaped outer and a ring-shaped inner drive ring, and are thereby held on a specific geometrical path and machined in material-removing fashion between two rotating working disks coated with bonded abrasive. The abrasive is composed of a film or "cloth" stuck to the working disks of the apparatus used, as disclosed in U.S. Pat. No. 6,007,407, for example.

It has been found, however, that the semiconductor wafers machined by this method have a series of defects, with the result that the semiconductor wafers obtained are unsuitable for particularly demanding applications: it has thus been shown, for example, that in general semiconductor wafers result which have a disadvantageous convex thickness profile with a pronounced edge roll-off. The semiconductor wafers often also have irregular undulations in their thickness profile and also a rough surface with a large damage depth. The high damage depth necessitates complicated subsequent machining that nullifies the advantage of the method disclosed in DE10344602A1. The remaining convexity and the remaining edge roll-off lead to incorrect exposures during the photolithographic device patterning and hence to the failure of the components. Semiconductor wafers of this type are therefore unsuitable for demanding applications.

It has furthermore been shown that, in particular when using the particularly preferred abrasive diamond, the carrier materials known in the prior art are subject to high wear and the abrasion produced adversely affects the cutting capacity (sharpness) of the working layer. This leads to an uneconomically short lifetime of the carriers and necessitates frequent unproductive redressing of the working layers. It has been shown, moreover, that carriers composed of metal alloys, in particular stainless steel, such as are used in lapping in accordance with the prior art, and have an advantageous low wear in that case, are particularly unsuitable for carrying out the methods according to the invention. Thus, by way of example, the known high solubility of carbon in iron/steel in the case of the (stainless) steel carriers leads to an immediate embrittlement and blunting of the diamond that is preferably used as the abrasive of the working layer. Moreover, the formation of undesirable deposits of iron carbide and iron oxide layers on the semiconductor wafers has been observed. It has been shown that high grinding pressures, in order to constrain self-dressing of the blunt working layer by pressure-induced forced wear, are unsuitable since the semiconductor wafers are then deformed and the advantage of FFP is nullified. Moreover, the fracturing of entire abrasive grains which repeatedly occurs leads to an undesirably high roughness and damage of the semiconductor wafers. The inherent weight of the carrier leads to different degrees of blunting of upper and lower working layer and thus to different roughness and damage of front and rear sides of the semiconductor wafer. It has been shown that the semiconductor wafer then becomes asymmetrically undulatory, that is to say has undesirably high values for "bow" and "warp" (strain-induced warpage).

SUMMARY OF THE INVENTION

It is an object of the present invention, therefore, to provide semiconductor wafers which, on account of their geometry, are also suitable for producing electronic components with very small linewidths ("design rules"). In particular, the object was established to avoid geometrical faults such as a thickness maximum in the center of the semiconductor wafer associated with a continuously decreasing thickness toward the edge of the wafer, an edge roll-off, or a local thickness minimum in the center of the semiconductor wafer. A further object was to avoid excessive surface roughness or damage of the semiconductor wafer. In particular, an object was to produce a semiconductor wafer with low bow and warp. A still further object was to improve the grinding method so as to avoid frequently replacing or restoring wearing parts, in order to enable economic operation. These and other objects are achieved by the simultaneous double sided grinding of a plurality of wafers positioned freely moveable in a corresponding plurality of carriers caused to rotate in a cycloidal fashion, and exposing the surfaces of the wafers to machining between two bonded-abrasive coated, rotating, ring-shaped working disks, by selecting special carriers for the wafers, by selecting the geometry of the grinding disks and wafers to produce an overhang, by measuring and adjusting the form of the working gap during machining, or preferably, by a combination of a plurality of these methods.

DETAILED DESCRIPTION OF THE PREFERRED EMBODIMENTS

Figure 3:
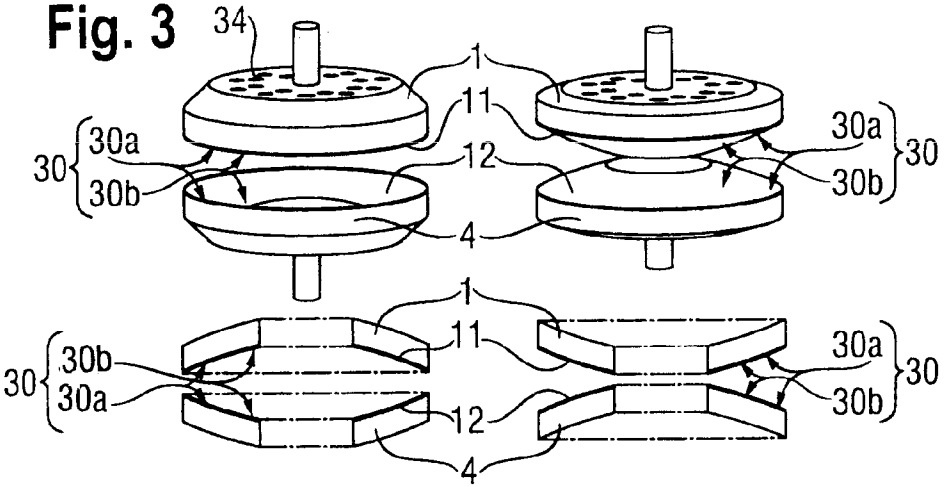
FIG. 3 shows the principle of a working gap—altered according to the invention—between the working disks of an apparatus suitable for carrying out one embodiment of a method according to the invention.

A first method for the simultaneous double-side grinding of a plurality of semiconductor wafers involves a process wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating ring-shaped working disks, wherein each working disk comprises a working layer containing bonded abrasive, wherein the form of the working gap formed between the working layers is determined during grinding and the form of the working area of at least one working disk is altered mechanically or thermally depending on the measured geometry of the working gap in such a way that the working gap has a predetermined form.

A second method for the simultaneous double-side grinding of a plurality of semiconductor wafers involves a process, wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating ring-shaped working disks, wherein each working disk comprises a working layer containing bonded abrasive, wherein part of the area of the semiconductor wafers, during machining, temporarily leave the working gap delimited by the working layers, wherein the maximum of the overrun in a radial direction is more than 0% and at most 20% of the diameter of the semiconductor wafer, wherein the overrun is defined as the length—measured in a radial direction relative to the working disks—by which a semiconductor wafer projects beyond the inner or outer edge of the working gap at a specific point in time during grinding.

A third method for the simultaneous double-side grinding of a plurality of semiconductor wafers involves a process, wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating ring-shaped working disks, wherein each working disk comprises a working layer containing bonded abrasive, wherein the carrier is completely composed of a first material, or a second material of the carrier is completely or partly coated with a first material in such a way that, during grinding, only the first material comes into mechanical contact with the working layer and the first material does not interact with the working layer to reduce the sharpness of the abrasive.

Each individual one of the abovementioned methods is suitable for producing a semiconductor wafer having significantly improved properties. A combination of two of the three or most preferably of all three methods mentioned above is furthermore suitable for producing a semiconductor wafer having particularly significantly improved properties.

The following is a list of reference symbols and abbreviations used in the drawing figures.

| | |
|---|---|
| 1 | Upper working disk |
| 4 | Lower working disk |
| 7 | Inner drive ring |
| 9 | Outer drive ring |
| 11 | Upper working layer |
| 12 | Lower working layer |
| 13 | Carrier |
| 14 | Cutout for receiving the semiconductor wafer |
| 15 | Semiconductor wafer |
| 16 | Midpoint of the semiconductor wafer |
| 17 | Pitch circle of midpoint of carrier in rolling apparatus |
| 18 | Reference point on semiconductor wafer |
| 19 | Trajectory of a reference point on the semiconductor wafer |
| 21 | Midpoint of the carrier |
| 22 | Midpoint of the rolling apparatus |
| 23 | Actuating element for wafer deformation |
| 30 | Working gap |
| 30a | Width of the working gap outside |
| 30b | Width of the working gap inside |
| 34 | Holes for supply operating agent |
| 35 | Measuring apparatus working gap temperature (inside) |

-continued

| | |
|---|---|
| 36 | Measuring apparatus working gap temperature (outside) |
| 37 | Measuring apparatus working gap width (inside) |
| 38 | Measuring apparatus working gap width (outside) |
| 39 | TTV distribution (machined with supervised working gap) |
| 40 | TTV distribution (with unsupervised working gap) |
| 41 | Working gap difference during machining |
| 42 | Temperature in the working gap outside |
| 43 | Temperature in the working gap inside |
| 44 | Temperature in the working gap center |
| 45 | Thickness profile after machining with overrun |
| 46 | Thickness profile after machining without overrun |
| 47 | Edge roll-off after machining without overrun |
| 48 | Removal rate with carrier not impairing sharpness |
| 49 | Removal rate with carrier reducing sharpness |
| 50 | Thickness profile in direction of notch |
| 51 | Thickness profile 45° with respect to notch |
| 52 | Average thickness profile |
| 53 | Thickness profile 135° with respect to notch |
| 54 | Warp after asymmetrical material removal |
| 55 | Warp after symmetrical material removal |
| 56 | Notch in the case of excessive overrun |
| 57 | Temperature in upper working disk (volume) |
| 58 | Roughness/damage after symmetrical material removal |
| 59 | Roughness/damage after asymmetrical material removal |
| 65 | Thickness profile 90° with respect to notch |
| 66 | Convexity in the case of unsupervised working gap |
| 67 | Material reference symbol of the carrier |
| 68 | Wear rate of the carriers |
| 69 | Ratio of material removal of the semiconductor wafer and wear of the carrier |
| 70 | Cutting capacity of the working layer after 10 min |
| 71 | Cutting capacity of the working layer after 30 min |
| 72 | Cutting capacity of the working layer after 60 min |
| 73 | Cutting capacity of the working layer after 10 to 60 min |
| 74 | Temporal development of the cutting capacity of the working layer (incomplete) |
| 75 | Outer toothing of the carrier |
| 76 | Cutout in the carrier |
| 77 | Lining of the opening for receiving the semiconductor wafer |
| 78 | Toothing for the positively locking connection of lining and carrier |
| 79a | Front-side coating of the carrier |
| 79b | Rear-side coating of the carrier |
| 80 | Edge left free in the coating of the carrier |
| 81 | Partial-area coating of the carrier in the form of a round "knob" |
| 82 | Partial-area coating of the carrier in the form of an elongate "bar" |
| 83 | Adhesive bonding of the partial-area coating to the carrier |
| 84 | Continuous, positively locking partial-area coating of the carrier |
| 85 | Calked (riveted) continuous partial-area coating of the carrier |
| 86 | Toothed outer ring of the carrier |
| 87 | Insert of the carrier |
| 90 | Measurement variable inner gap measuring sensor |
| 91 | Measurement variable outer gap measuring sensor |
| 92 | Differential element distance signal |
| 93 | Control element gap adjustment |
| 94 | Manipulated variable gap adjustment |
| 95 | Measurement variable inner temperature sensor |
| 96 | Measurement variable outer temperature sensor |
| 97 | Differential element temperature signal |
| 98 | Control element gap temperature adjustment |
| 99 | Manipulated variable gap temperature adjustment |
| A | Relative wear rate of the carrier |
| ASR | Working disk radius |
| D | Thickness |
| F | Force |
| G | Ratio of material removal of the semiconductor wafer and wear of the carrier ("G factor") |
| H | Frequency (for cumulated distribution) |
| MAR | Average removal rate |
| R | Radius (of the semiconductor wafer) |
| RG | Relative gap width (relative gap) |
| RMS | Root-mean-square; roughness |
| S | Relative cutting capacity of the working layer |
| SSD | Sub-surface damage |
| t | Time |
| T | Temperature |
| TTV | Total thickness variation |
| W | Warp |

Figure 1:
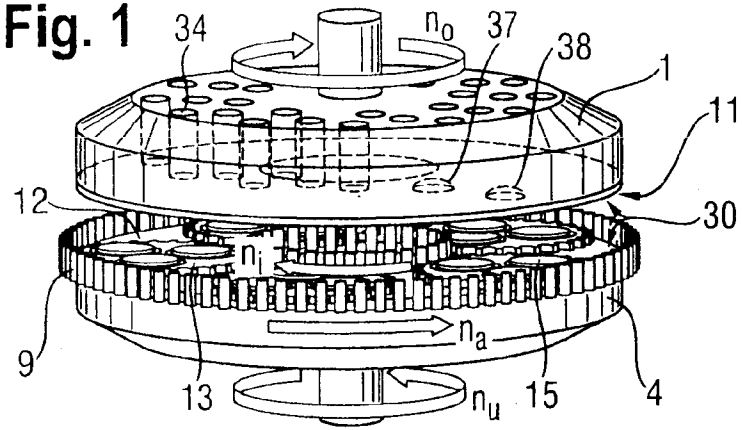
FIG. 1 shows an apparatus suitable for carrying out one embodiment of a method according to the invention in perspective view.
Figure 2:
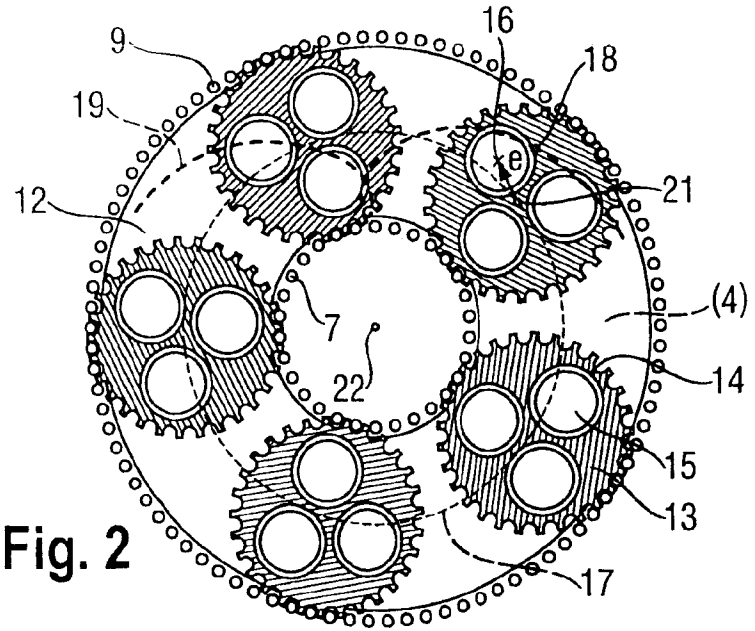
FIG. 2 shows an apparatus suitable for carrying out one embodiment of a method according to the invention in a plan view of the lower working disk.

FIG. 1 shows the essential elements of an apparatus according to the prior art that is suitable for carrying out the methods according to the invention. The illustration shows the basic schematic diagram of a two-disk machine for machining disk-shaped workpieces such as semiconductor wafers, such as is disclosed for example in DE10007390A1, in perspective view (FIG. 1) and in a plan view of the lower working disk (FIG. 2).

An apparatus of this type comprises an upper working disk 1 and a lower working disk 4 and a rolling apparatus formed from an inner toothed ring 7 and an outer toothed ring 9, carriers 13 being inserted into said rolling apparatus. The working disks of an apparatus of this type are ring-shaped. The carriers have cutouts 14 which receive the semiconductor wafers 15. The cutouts are generally arranged such that the midpoints 16 of the semiconductor wafers lie with an eccentricity e with respect to the center 21 of the carrier.

During machining, the working disks 1 and 4 and the toothed rings 7 and 9 rotate at rotational speeds $n_o$, $n_u$, $n_i$ and $n_a$ concentrically about the midpoint 22 of the entire apparatus (four-way drive). As a result, the carriers on the one hand circulate on a pitch circle 17 about the midpoint 22 and on the other hand simultaneously form an inherent rotation about their respective midpoints 21. For an arbitrary reference point 18 of a semiconductor wafer, a characteristic trajectory 19 (kinematics) results with respect to the lower working disk 4 or working layer 12, this trajectory being referred to as a trochoid. A trochoid is understood as the generality of all regular, shortened or lengthened epi- or hypocycloids.

Upper working disk 1 and lower working disk 4 bear working layers 11 and 12 containing bonded abrasive. Suitable working layers are described in U.S. Pat. No. 6,007,407, for example. The working layers are preferably configured in such a way that they can be rapidly mounted or demounted. The interspace formed between the working layers 11 and 12 is referred to as the working gap 30, in which the semiconductor wafers move during the machining. The working gap is characterized by a width that is measured perpendicular to the surfaces of the working layers and is dependent on the location (in particular on the radial position).

At least one working disk, for example the upper working disk 1, contains holes 34 through which operating agents, for example a cooling lubricant, can be supplied to the working gap 30.

In order to carry out the first method according to the invention, preferably at least one of the two working disks, for example the upper working disk, is equipped with at least two measuring apparatuses 37 and 38, of which preferably one (37) is arranged as near as possible to the inner edge of the ring-shaped working disk and one (38) is arranged as near as possible to the outer edge of the working disk and which perform a contactless measurement of the respective local distance of the working disks. Apparatuses of this type are known in the prior art and disclosed in DE102004040429A1, for example.

For a particularly preferred implementation of the first method according to the invention, at least one of the two working disks, for example the upper working disk, is additionally equipped with at least two measuring apparatuses 35 and 36, of which preferably one (35) is arranged as near as possible to the inner edge of the ring-shaped working disk and one (36) is arranged as near as possible to the outer edge of the working disk and which perform a measurement of the temperature at the respective location within the working gap.

According to the prior art, the working disks of apparatuses of this type generally contain an apparatus for setting a working temperature. By way of example, the working disks are provided with a cooling labyrinth through which flows a coolant, for example water, which is temperature-regulated by means of thermostats. A suitable apparatus is disclosed in DE19937784A1, for example. It is known that the form of a working disk is altered if the temperature of the working disk changes.

The prior art furthermore discloses apparatuses which can be used to alter the form of one or both working disks and thus the profile of the working gap between the working disks in a targeted manner by virtue of radial forces acting symmetrically on that side of the working disk which is remote from the working gap. Thus, DE19954355A1 discloses a method in which the forces are generated by means of the thermal expansion of an actuating element which can be heated or cooled by a temperature-regulating device. Another possibility for the targeted deformation of one or both working disks may consist for example in the required radial forces F being generated by means of a mechanically hydraulic adjusting device. By changing the pressure in such a hydraulic adjusting device, it is possible to alter the form of the working disk and thus the form of the working gap. Instead of the hydraulic adjusting device, however, it is also possible to use piezoelectric (piezo-crystals) or magnetostrictive (coils through which current flows), or electrodynamic actuating elements ("voice coil actuator"). In this case, the form of the working gap is altered by influencing the electrical voltage or the electric current in the actuating elements.

Figure 25A:
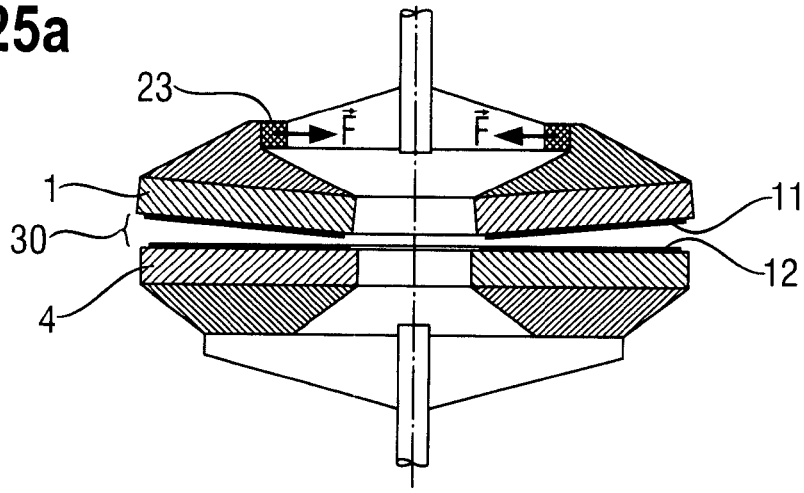
FIG. 25 shows the principle of the adjustment according to the invention of the form of a working disk by the action of symmetrical, radial forces.
Figure 25B:
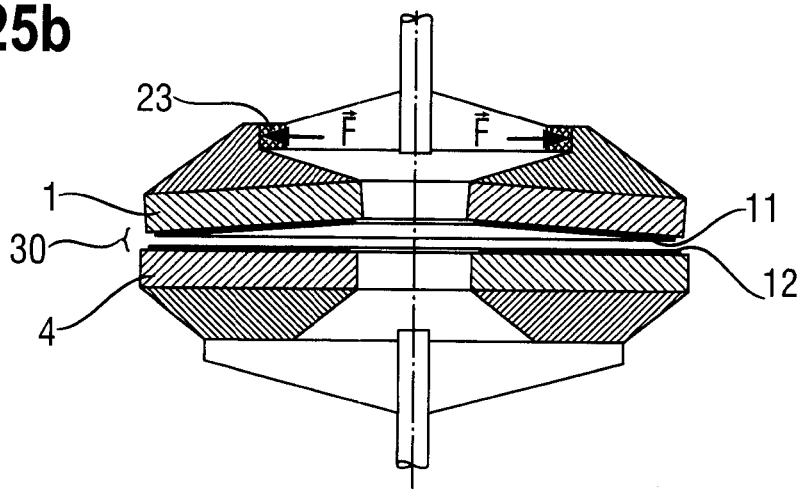

FIG. 25*a* and FIG. 25*b* schematically show how the form of the working gap 30 can be altered by virtue of an adjusting apparatus 23 acting on the upper working disk 1 and deforming the latter.

Such apparatuses can be used to set in particular in a targeted manner convex or concave deformations of the working disk. These are particularly well suited to counteracting the undesirable deformations of the working gap by the alternating loads during the machining. Such concave (left) and convex (right) deformations of the working disks are illustrated as a basic schematic diagram in F*igure* 3. 30*b* denotes the width of the working gap 30 near the inner edge of the ring-shaped working disk and 30*a* denotes the width of the working gap near the outer edge of the working disk.

In accordance with the first method according to the invention, the form of the working gap formed between the working layers is determined during grinding and the form of the working area of at least one working disk is altered mechanically or thermally depending on the measured geometry of the working gap in such a way that the working gap has a predetermined form. Preferably, the form of the working gap is controlled in such a way that the ratio of the difference between the maximum and minimum widths of the working gap to the width of the working disks, at least during the last 10% of the material removal, is at most 50 ppm. The expression "width of the working disks" should be understood to mean the ring width thereof in the radial direction. If the entire area of the working disks is not coated with a working layer, the expression "width of the working disks" should be understood to mean the ring width of that area of the working disks which is coated with a working layer. "At least during the last 10% of the material removal" means that the condition "at most 50 ppm" is met during the last 10 to 100% of the material removal. This condition can therefore also be met according to the invention during the entire grinding method. "At most 50 ppm" means a value within the range of 0 ppm to 50 ppm. 1 ppm is synonymous with the number $10^{-6}$.

Preferably, during the course of grinding, the gap is measured continuously by means of at least two contactless distance measuring sensors incorporated into at least one of the working disks and at least one of the two working disks is constantly readjusted by measures for targeted deformation in such a way that despite an alternating thermal load input during the machining, which, as is known, brings about an undesirable deformation of the working disks, a desired course of the working gap is always obtained.

In one preferred embodiment of the first method according to the invention, the above-described cooling labyrinths in the working disks are used for controlling the working disk form. This involves firstly determining the radial profile of the working gap in the rest state of the grinding apparatus used, for a plurality of temperatures of the working disks. For this purpose, by way of example, the upper working disk with three identical end measures at fixed points and under fixed applied load is brought to nominally uniform distance with respect to the lower working disk and the radial profile of the resulting gap between the working disks is determined for example using a micrometer probe. This is carried out for different temperatures of the cooling circuit of the working disks. This yields a characterization of the alteration of the form of the working disks and of the working gap depending on the temperature.

During the machining, through continuous measurement by means of the contactless distance measuring sensors, a change in the radial working gap profile is then determined and counteractively controlled by a targeted change in the operating disk temperature regulation according to the known temperature characteristic in such a way that the working gap always maintains the desired radial profile. This is done for example by changing the flow temperature of the thermostats for the cooling labyrinths of the working disks during the machining in a targeted manner.

This first method according to the invention is based on the observation that an undesired alteration of the form of the working gap always occurs during the machining, and that this alteration cannot be avoided by measures in accordance with the prior art such as, for example, a constant working disk temperature regulation. Such an undesirable gap change is brought about for example by the input of alternating thermal loads during the machining. This may be the material-removing work performed during the material removal in the course of the machining on the workpiece, the work fluctuating depending on the machining progress with the varying sharpness state of the grinding tool. Mechanical deformations of the working disks also occur on account of the different machining pressures generally chosen during the machining (applied load of the upper working disk) and also as a result of varying wobbling of the working disk at different machining speeds (kinematics). A further example of varying machining conditions which lead to an undesirable deformation of the working disks is chemical reaction energies when specific operating agents are added to the working gap. Finally, the power losses of the apparatus drives themselves lead to continuously variable operating conditions.

In a further embodiment of this first method, the temperature regulation of the working gap is performed using operating medium (cooling lubricant, "grinding water") supplied to the working gap during the machining, by varying the temperature progression or volumetric flow rate of said medium in such a way that the working gap assumes the desired form. It is particularly advantageous to combine the two control measures, since the reaction times of the change in form as a result of the temperature regulation of the working disk and the grinding water supply are different, and control of the working gap that is even better adapted to the requirements is thus possible. The control requirements vary for example in the case of varying desired material removals, different grinding pressures, different cutting properties of working layers of different compositions, etc.

It is also preferred to use temperature sensors which determine the temperature in the working gap at different locations during the machining (temperature profile). This is because it has been shown that temperature changes in the working gap often precede the undesirable changes in the form of the working gap during the machining. The control according to the invention of the form of the working gap on the basis of temperature changes makes it possible to achieve a particularly rapid control of the form of the working gap.

The control of the form of the working gap can therefore be performed by a direct change in form of at least one of the working disks, for example by means of the hydraulic or thermal form changing apparatus described, or an indirect change in form by changing the temperature or quantity of the operating agent supplied to the working gap (thereby bringing about a change in temperature of the working gap and therefore also of the working disks, which alter the form of the working gap). It is particularly advantageous to control the working gap by detecting the widths of the working gap or the temperatures prevailing therein, feeding back the measured values into the control unit of the apparatus and tracking pressure or temperature (direct change in form) or temperature and quantity (indirect change in form) in a closed control loop. For both methods—direct or indirect change in form of the working gap—the width or the temperature of the working gap can optionally be used for determining the control deviation. The use of the measured width of the working gap for determining the control deviation has the advantage of absolute consideration of the gap deviation (in micrometers) and the disadvantage of the time delay. The use of the temperatures measured in the working gap has the advantage of higher speed, since control deviations are already taken into account even before the working disk has deformed, and the disadvantage that precise prior knowledge of the dependence of the form of the working gap on temperature must be available (reference gap profiles).

A particularly advantageous embodiment consists in a combination of the two methods. Preferably, the form of the working gap, owing to the high speed of this control, is controlled on a short time scale on the basis of the temperatures measured in the working gap. The measured widths of the working gap at the inner and outer edges of the working disks are preferably used, by contrast, in order to ascertain a drift in the form of the working gap, said drift taking place on a long time scale, and, if appropriate, to counteractively control said drift.

Figure 26:
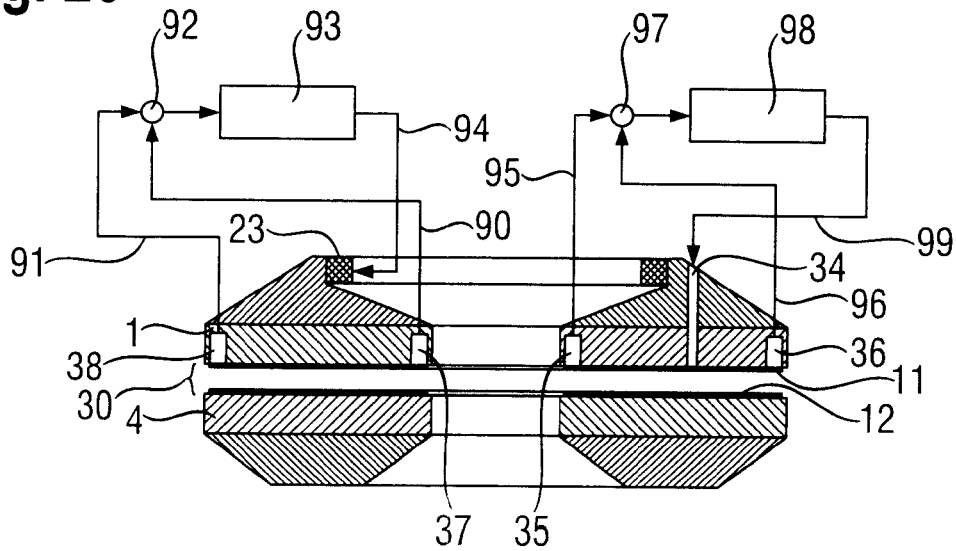
FIG. 26 shows the principle of the control according to the invention of the geometry of the working gap by combination of a fast control of the temperature in the working gap and a slow control of the form of the working disk.

One configuration of this particularly advantageous embodiment is illustrated schematically in FIG. 26. In a first, slow control loop, the contactless distance sensors 37 and 38 continuously transmit measurement signals 90 and 91 to a control element 93 via a differential element 92. The control element transmits a manipulated variable 94 to an actuating element 23 for disk deformation. A slow drift in the geometry of the working gap can thus be corrected. In a second, fast control loop, the temperature sensors 35 and 36 transmit measurement signals 95 and 96 to a control element 98, the manipulated variable 99 of which, depending on the predetermined desired temperature profile, affects the temperature and/or the flow rate of a cooling lubricant supplied to the working gap. A temperature change in the working gap can thus be counteractively controlled even before the gap geometry is influenced thereby.

It has been shown that the greatest flatness of the semiconductor wafers in the case of machining by the method according to the invention is obtained if the working gap has a largely uniform width in the radial direction during machining, that is to say that the working disks run parallel to one another or have a slight gape from the inside toward the outside. In a further embodiment of this first method, therefore, a working gap which is constant or widens slightly from the inside toward the outside is preferred. In the case of an exemplary apparatus whose working disks have an external diameter of 1470 mm and an internal diameter of 561 mm, the width of the working disks is consequently 454.5 mm. On account of their finite installation size, the distance sensors are not situated precisely on the inner and outer edges of the working disk, but rather on pitch circle diameters of 1380 mm (outer sensor) and 645 mm (inner sensor), such that the sensor distance is 367.5 mm, that is to say around 400 mm. A radial profile of the width of the working gap between inner and outer sensors within the range of 0 μm (parallel course) to 20 μm (widening from the inside toward the outside) has proved to be particularly preferred. The ratio of the difference between the width of the working gap at the outer and inner edges to the width of the working disks, which is taken into account in the measurement, is therefore most preferably between 0 and 20 μm/400 mm=50 ppm.

The suitability of this first method for achieving the object on which the invention is based: that of providing particularly planar semiconductor wafers is illustrated by FIGS. 5, 6, 8 and 17.

Figure 5:
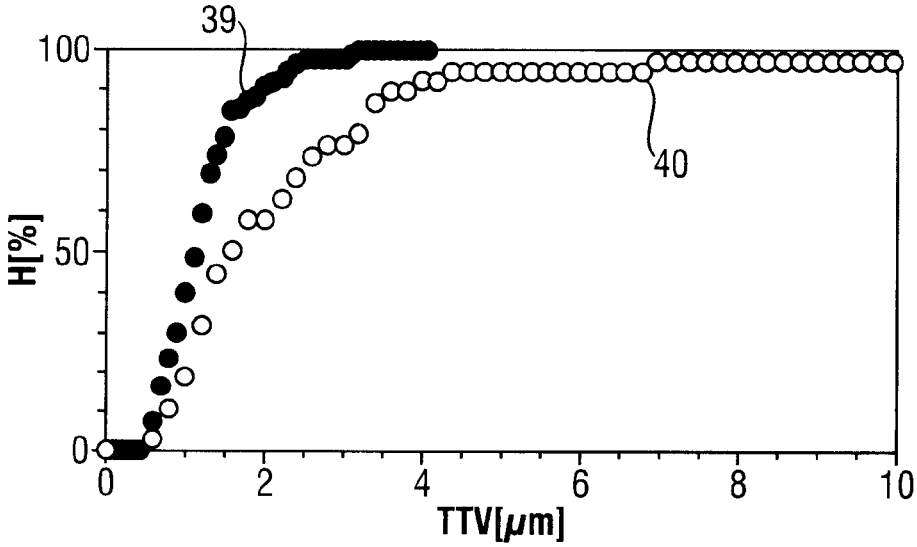
FIG. 5 shows the cumulative frequency distribution of the TTV of semiconductor wafers which were machined with a working gap altered according to the invention, in comparison with the geometry distribution of semiconductor wafers which were machined with a working gap not altered according to the invention. (TTV=total thickness variation; difference between the largest and smallest thicknesses of the semiconductor wafer.)

FIG. 5 shows the frequency distribution H (in percent) of the TTV of semiconductor wafers which were machined with a working gap controlled according to the invention by means of cooling labyrinths and measurement of the width of the working gap (39), in comparison with the distribution of the TTV of semiconductor wafers which were machined with the working gap not controlled according to the invention (40). The method according to the invention of controlling the working gap leads to significantly better TTV values. (The TTV="total thickness variation" denotes the difference between the largest and smallest thicknesses measured over the entire semiconductor wafer. The TTV values shown were determined by means of a capacitive measuring method.)

If a particularly small total material removal is demanded for the machining of the semiconductor wafers by the method according to the invention, the machining duration is often shorter than the reaction time of the described measures according to the invention for controlling the working gap. It has been shown that in such cases it suffices for the working gap to run with the preferred radially homogeneous width or slight gape from the inside toward the outside at least toward the end of the machining, that is to say during the last 10% of the material removal.

Figure 6:
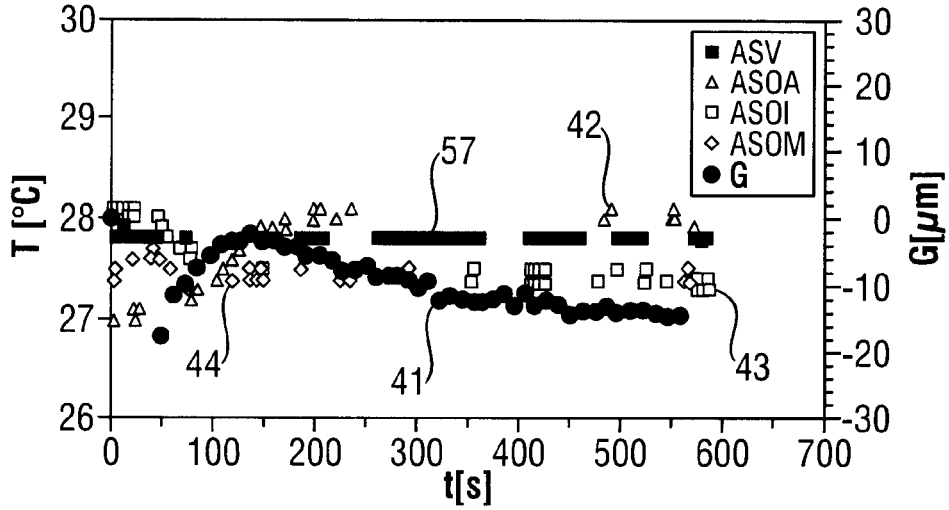
FIG. 6 shows the gape—measured during the machining—of the working gap which was kept approximately constant according to the invention by controlling the working disk form, and also resulting surface temperatures at different locations in the working gap. (Gape=difference between the width of the working gap near the inner edge of the working disk and that near the outer edge of the working disk.)

FIG. 6 shows the difference 41—measured in a method according to the invention—between the width of the working gap near the internal diameter and that near the external diameter of the working disks during the machining. The total machining time was approximately 10 min. A total material removal of the semiconductor wafers of 90 μm was obtained. The average removal rate was therefore approximately 9 μm/min. The working gap runs, apart from the pressure build-up phase within the first 100 s, according to the invention in parallel fashion or with slight gape. The gap widening from the inside toward the outside at the end of the machining is approximately 15 μm according to the invention.

The figure likewise shows the temperatures—measured during the machining—at different locations of the surface—delimiting the working gap toward one side—of the upper working disk near the internal diameter of the ring-shaped working disk (43), in the center (44) and near the external diameter (42), and also the average temperature 57 in the volume of the working disk. The form and temperature of the working disk were controlled by the described method according to the invention in such a way that the working gap runs in parallel fashion or with slight gape over the entire machining time. (G="gap difference", difference between gap width measured on the inside and on the outside; ASV=temperature at the working disk surface in the volume; ASOA=temperature at the working disk surface on the outside; ASOI=temperature at the working disk surface on the inside; ASOM=temperature of the surface in the center between "inside" and "outside"; T=temperature in degrees Celsius, t=time).

Figure 16:
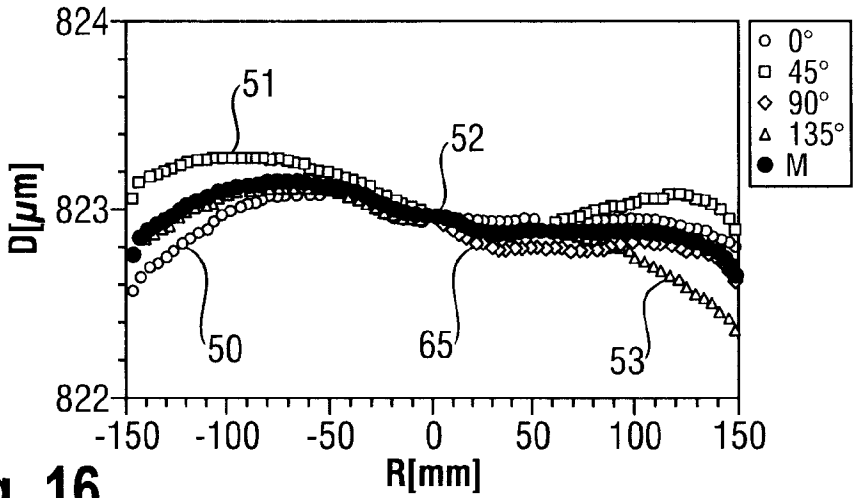
FIG. 16 shows diametrical sections of the thickness profile of a semiconductor wafer which was machined by a method according to the invention with a controlled working gap.

FIG. 16 shows the associated thickness profile of this semiconductor wafer machined with a controlled working gap according to the invention. The illustration shows four diametrical profiles of the thickness, carried out at 0° (50), 45° (51), 90° (65) and 135° (53) with respect to the notch of the semiconductor wafer. 52 represents the diametrical profile averaged over the four individual profiles (D=local thickness in micrometers, R=radial position of the semiconductor wafer in millimeters). The measured values were determined by means of a capacitive thickness measuring method. In the example shown of the semiconductor wafer machined with a controlled working gap according to the invention, the TTV, that is to say the difference between the largest and smallest thicknesses over the entire semiconductor wafer, is 0.55 μm.

Figure 7:
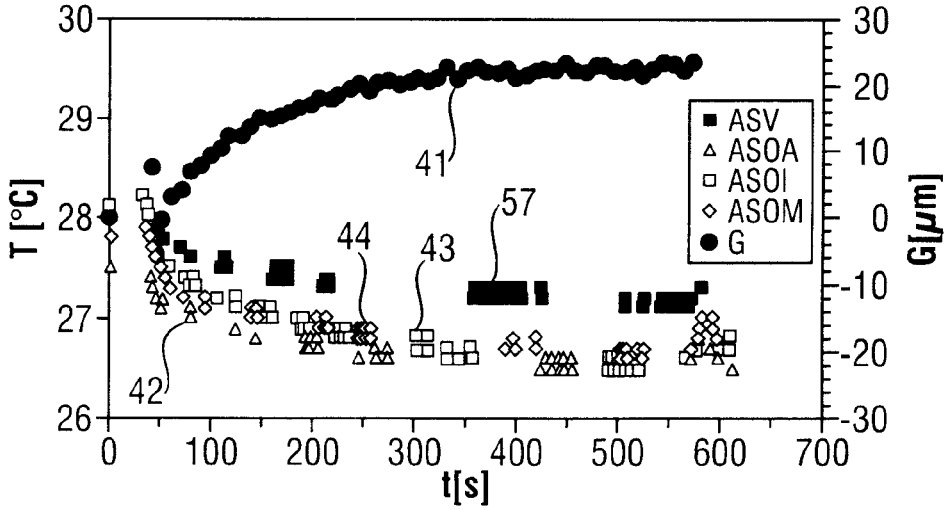
FIG. 7 shows the gape—measured during the machining—of the working gap which was not controlled according to the invention during the machining, and the changing temperatures at different locations of the working gap.

FIG. 7 shows, as a comparative example, the profile of working gap difference 41 and temperatures on the inside 43, in the center 44, on the outside 42 and in the volume 57 in a method that is not carried out according to the invention. The temperatures and form change on account of the described alternating thermal and mechanical loads input during the machining. The working gap was not readjusted and, at the end of the machining, has a constriction—not according to the invention—by approximately 25 μm from the inside toward the outside.

Figure 17:
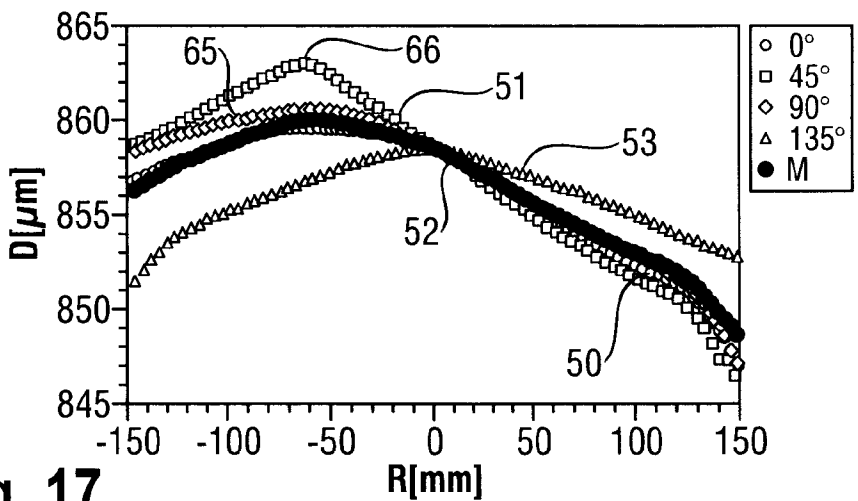
FIG. 17 shows diametrical sections of the thickness profile of a semiconductor wafer which was machined by a method not according to the invention, with an uncontrolled working gap.

FIG. 17 shows the associated thickness profile of the semiconductor wafer not machined according to the invention in the comparative example, in which the working gap was not controlled during the machining. The extreme convexity of the semiconductor wafer obtained is clearly discernible, with a pronounced point of maximum thickness 66. On account of the size of the apparatus used (ring width of the working disk 454.5 mm) and the size of the semiconductor wafers (300 mm), each carrier can only receive one semiconductor wafer. The eccentricity e of the midpoint 16 of the semiconductor wafer with respect to the midpoint 21 of the carrier was e=75 mm (FIG. 2). The point 66 of maximum thickness correspondingly lies approximately 75 mm eccentrically with respect to the center of the semiconductor wafer (FIG. 17). The resulting semiconductor wafer is therefore not rotationally symmetrically, in particular. The TTV of the semiconductor wafer shown in the comparative example not according to the invention is 16.7 μm.

The second method according to the invention is described in more detail as follows. In this method, the semiconductor wafers, during the machining, temporarily leave the working gap over a specific portion of their area and the kinematics of the machining are preferably chosen in such a way that on account of this "overrun" of the semiconductor wafers in the course of machining gradually the entire area of the working layers including their edge regions is swept over completely, and substantially equally often. The "overrun" is defined as the length—measured in the radial direction relative to the working disks—by which a semiconductor wafer projects beyond the inner or outer edge of the working gap at a specific point in time during grinding. According to the invention, the maximum of the overrun in the radial direction is more than 0% and at most 20% of the diameter of the semiconductor wafer. In the case of a semiconductor wafer having a diameter of 300 mm, the maximum overrun is therefore more than 0 mm and at most 60 mm.

Figure 4:
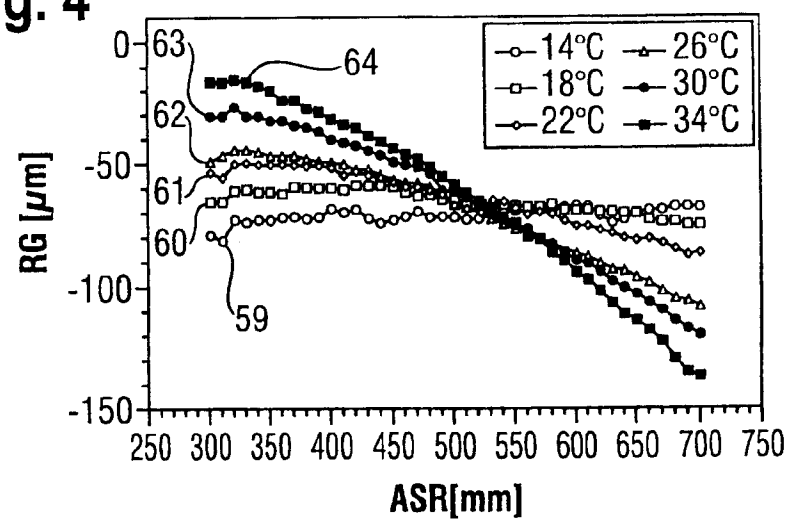
FIG. 4 shows radial profiles of the working gap formed by the two working disks of an apparatus suitable for carrying out one embodiment of a method according to the invention, for different temperatures.

This second method according to the invention is based on the observation that in the comparative example of a grinding method in which the semiconductor wafers always remain completely within the working gap, a trough-shaped radial profile of the working layer thickness results in the course of the wear of the working layers. This has been shown by measurements of the gap profile according to the method from FIG. 4.

The larger thickness of the working layer toward the inner and outer edges of the ring-shaped working disks leads to a reduced working gap there, which brings about a higher material removal of those regions of the semiconductor wafer which sweep over this region in the course of machining. The semiconductor wafer acquires an undesirable convex thickness profile with a thickness that decreases toward its edge ("edge roll-off").

If, in the context of the second method according to the invention, the conditions are then chosen in such a way that the semiconductor wafer temporarily runs with part of its area beyond the inner and outer edges of the working layers, a wear that is largely uniform radially over the entire ring width of the working layer takes place, no trough-shaped radial profile of the working layer thickness is formed, and no edge roll-off of the semiconductor wafer machined according to the invention in this way is brought about.

In one embodiment of this second method, the eccentricity e of the semiconductor wafer in the carrier is chosen with a magnitude such that a temporary overrun according to the invention of part of the area of the semiconductor wafer beyond the edge of the working layer takes place during the machining.

In another embodiment of this second method, the working layer is trimmed in ring-shaped fashion at the inner and outer edges in such a way that a temporary overrun according to the invention of part of the area of the semiconductor wafer beyond the edge of the working layer takes place during the machining.

In a further embodiment of this second method, an apparatus is chosen with such a small diameter of the working disks that the semiconductor wafer temporarily runs according to the invention with part of its area beyond the edge of the working disks.

A suitable combination of all three embodiments mentioned is also particularly preferred.

The requirement of this second method according to the invention that the semiconductor wafers gradually sweep over the entire area of the working layers including their edge regions completely and substantially equally often is met by virtue of the fact that the main drives of an apparatus suitable for carrying out the method according to the invention are generally AC servomotors (AC=alternating current) in which, in principle, a variable delay occurs between desired and actual rotational speeds (trailing angle). Even if the rotational speeds for the drives are chosen in such a way that nominally periodic paths result, which are particularly disadvantageous for carrying out the method according to the invention, in practice ergodic (aperiodic) paths are always produced on account of the AC servocontrol. The above requirement is thus always met.

Figure 8:
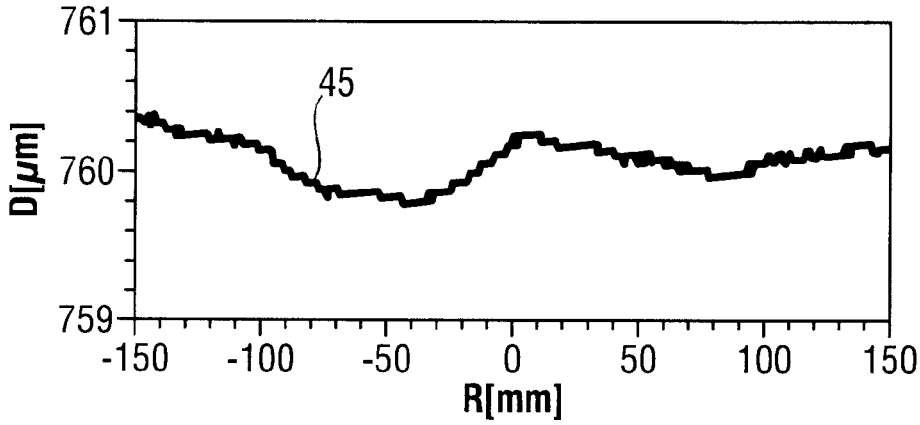
FIG. 8 shows the thickness profile of a semiconductor wafer which was machined by a method according to the invention, in which the semiconductor wafer temporarily leaves the working gap with part of its area during the machining.

FIG. 8 shows the thickness profile 45 of a semiconductor wafer having a diameter of 300 mm machined in accordance with the second method according to the invention. The overrun was 25 mm. The semiconductor wafer has only small random thickness fluctuations and has, in particular, no edge roll-off. The TTV is 0.61 μm.

Figure 9:
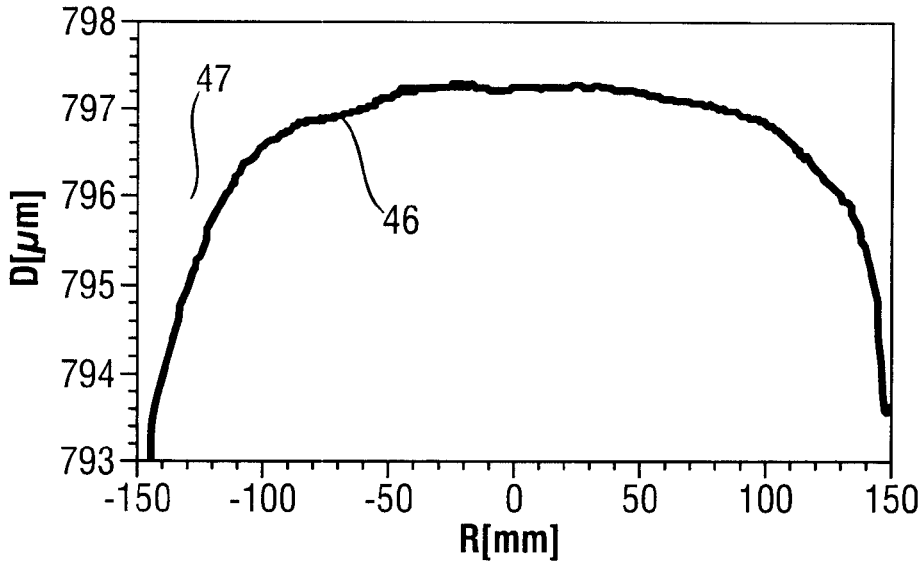
FIG. 9 shows the thickness profile of a semiconductor wafer which was machined by a method not according to the invention, in which the semiconductor wafer remains with its whole area in the working gap throughout the machining.

FIG. 9 represents, as a comparative example, the thickness profile 46 of a semiconductor wafer having a diameter of 300 mm that was not machined according to the invention, during the machining of which the semiconductor wafer always remained with its whole area in the working gap. This results in a pronounced thickness decrease 47 in the edge region of the semiconductor wafer. The TTV is more than 4.3 μm.

Figure 10:
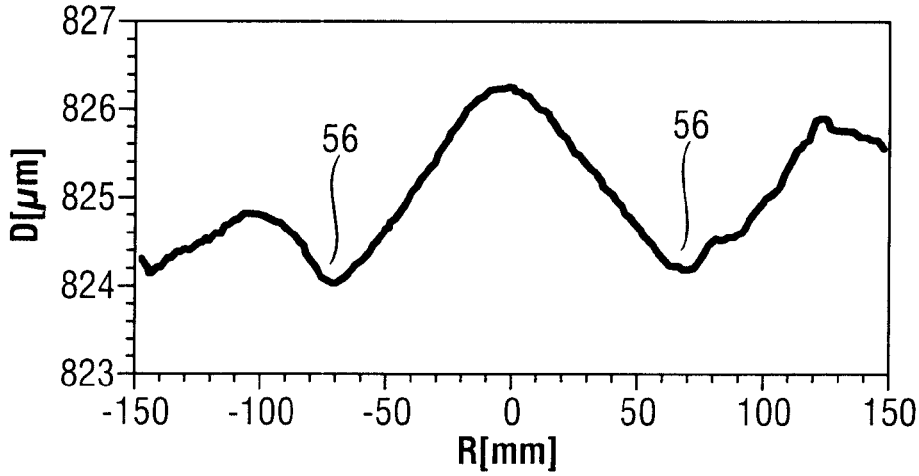
FIG. 10 shows the thickness profile of a semiconductor wafer which was machined by a method not according to the invention, in which the semiconductor wafer temporarily leaves the working gap with part of its area, but with an excessively large area region, during the machining.

FIG. 10 represents, as a further comparative example, the thickness profile of a semiconductor wafer having a diameter of 300 mm that was not machined according to the invention, during the machining of which the overrun was large, namely 75 mm, in a manner not according to the invention. Significantly pronounced notches 56 occur at a distance from the edge of the semiconductor wafer which corresponds to the width of the overrun (75 mm).

Specifically, it has been shown that in the case of excessive overrun on account of the lack of guidance of the semiconductor wafer outside the working gap, the semiconductor wafer, owing to flexure of semiconductor wafer or carrier, partly emerges in the axial direction from that cutout of the carrier which guides it. When the overrunning part of the semiconductor wafer enters the working gap again, the semiconductor wafer is then supported on the edge of the carrier cutout by a part of the generally rounded edge of said wafer. In the case of an overrun which is not excessively large, the semiconductor wafer, when entering the working gap again, is forced back into the cutout under friction; in the case of an excessively high overrun, this fails to occur, and the semiconductor wafer breaks. This "snapping back" into the carrier cutout leads to excessively increased material removal in the region of the edge of the working layer. This produces the notches 56 occurring in the comparative example of FIG. 10. The TTV of the semiconductor wafer of the comparative example is 2.3 μm. The notches 56 are particularly harmful since, on account of the greater material removal there, the roughness and damage depth are increased and the great curvature of the thickness profile in the region of the notches 56 has a particularly adverse effect on the nanotopology of the semiconductor wafer.

According to the invention, the overrun is more than 0% and less than 20% of the diameter of the semiconductor wafer and preferably between 2% and 15% of the diameter of the semiconductor wafer.

The third method according to the invention is described in more detail below. This method involves the use of carriers with a precisely defined interaction with the working layers. According to the invention, the carriers either enter into a very small interaction with the working layers, such that the cutting behavior of the latter is not impaired, or the carriers enter into a particularly great interaction with the working layers, which roughens the working layer in a targeted manner, such that said working layers are continuously dressed during the machining. This is achieved through a suitable choice of the material of the carriers.

The third method according to the invention is based on the following observation: the materials for carriers which are known in the prior art are completely unsuitable for carrying out the grinding method. Carriers composed of metal such as are used for example during lapping and during double-side polishing are subject to extremely high wear during the grinding method and enter into an undesirably great interaction with the working layer. The working layers preferably contain diamond as abrasive. The high wear observed is caused by the known high abrasive effect of diamond on hard materials; the undesirable interaction consists for example in the fact that the carbon of which diamond consists alloys in particular into iron metals (steel, stainless steel) at a high rate. The diamond becomes brittle and rapidly losses its cutting effect, such that the working layer becomes blunt and has to be redressed. Such frequent redressing leads to uneconomic consumption of working layer material, undesirable frequent interruptions of the machining and to unstable machining sequences with poor results for surface constitution, form and thickness consistency of the semiconductor wafers machined in this way. In addition, contamination of the semiconductor wafer with metallic abraded material is undesirable. Similarly disadvantageous properties were also observed on other carrier materials that were likewise tested, for example aluminum, anodized aluminum, metallically coated carriers (for example hard chromium-plated protective layers or layers composed of nickel-phosphorus).

Wear protection coatings of the carrier composed of materials having a high hardness, low coefficient of sliding friction and, according to comparative tables, low wear under friction are known according to the prior art. While they exhibit very little wear for example during double-side polishing and carriers coated therewith stand up to a few thousand machining cycles, it has been shown that such nonmetallic hard coatings are subject to extremely high wear during the grinding method and are therefore unsuitable. Examples are ceramic or vitreous (enamel) coatings and also coatings composed of diamond-like carbon (DLC).

It has furthermore been observed that during the grinding method, each investigated material for the carrier is subject to greater or lesser wear and that the material abrasion that occurs generally enters into an interaction with the working layer. This usually leads to a rapid loss of sharpness (cutting capacity) or great wear of the working layer. Both are undesirable.

In order to find suitable materials for carriers which do not have the disadvantages mentioned, a multiplicity of specimen carriers were investigated. It was found that some materials or coatings of the carrier, if they are only subjected to the action of the working layer alone, actually have the expected properties. By way of example, commercially available so-called "sliding coatings" or "wear protection coatings", for example composed of polytetrafluoroethylene (PTFE) prove to be resistive to the action of the working layer alone. If, however, carriers coated in this way, when carrying out the method according to the invention, are subjected to the action of the working layer and the action of the grinding slurry that is produced by the machining and contains silicon, for example, then it was found that said sliding or protection coatings also wear extremely rapidly.

This is due to the fact that the diamond fixedly bonded in the working layer produces a grinding effect and the silicon, silicon dioxide and other particles contained loosely in the silicon slurry produced produce a lapping effect. This mixed loading consisting of grinding and lapping constitutes a completely different loading for the carrier materials from that effected by grinding or lapping alone in each case.

For bringing about the third method according to the invention, a multiplicity of carriers composed of different materials were produced and subjected to a comparative test for determining material wear and interaction with the working layer. This "accelerated wear test" is described as follows: an apparatus suitable for carrying out the method according to the invention in accordance with FIG. 1 and FIG. 2 is used. The upper working disk is not used during the test and is pivoted out. Before beginning the test series for a carrier material, the lower working layer 12 is in each case dressed freshly and by a dressing method that is kept constant, in order to create identical starting conditions. The average thickness of a carrier 13 composed of a material whose wear and interaction behavior is to be investigated is measured at a plurality of points (micrometers) and as an alternative, given knowledge of the relative density of carrier and coating, determined by means of weighing. The carrier is inserted into the rolling apparatus 7 and 9 and loaded uniformly with a first weight. The average thickness of a semiconductor wafer 15 is measured or, preferably, determined by means of weighing. The semiconductor wafer is inserted into the carrier and loaded uniformly with a second weight. The lower working disk 4 with the lower working layer 12 and the rolling apparatus 7 and 9 are set in motion with fixed preselected rotational speeds for a specific time duration. After the time has elapsed, the movement is stopped, carrier and semiconductor wafer are removed and, after cleaning and drying, their average thicknesses are determined. During the movement of working disk and rolling apparatus relative to carrier and semiconductor wafer under load, a material removal (undesirable wear) from the carrier and a material removal from the semiconductor wafer (desired grinding effect) take place. This sequence of weighing, wear/removal action and weighing is repeated a number of times.

Figure 18:
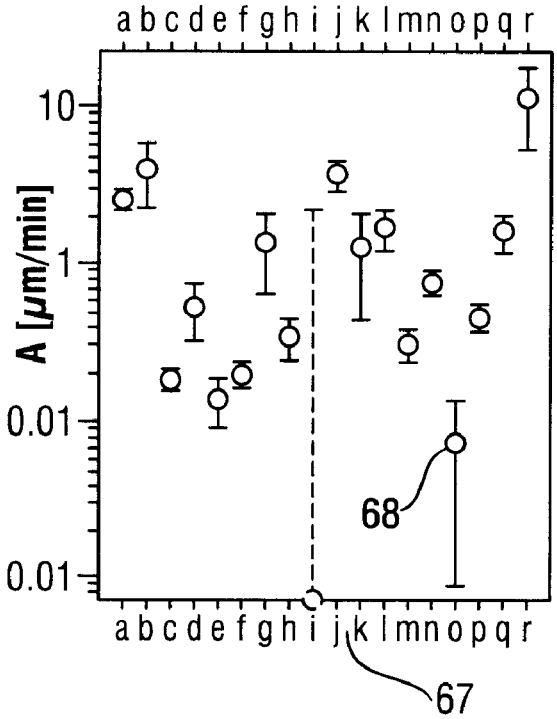
FIG. 18 shows the wear rate of the carriers in the "accelerated wear test" for various tested materials.

FIG. 18 shows the average thickness loss determined (wear rate A) for carriers in μm/min for a multiplicity of materials, plotted logarithmically. The materials 67 of the carriers which come into contact with the working layer and the grinding slurry from the removal of the semiconductor wafer during the test and the experimental conditions are specified in table 1. Table 1 also specifies whether the carrier material that comes into contact with working layer and grinding slurry was present as a coating ("layer", for example applied by spraying, dipping, spreading and, if appropriate, subsequent curing), as a film or as a solid material. The abbreviations used in table 1 denote: "GFP"=glass fiber reinforced plastic, "PPFP"=PP fiber reinforced plastic. The abbreviations for the various plastics are those which are generally conventional: EP=epoxide; PVC=polyvinyl chloride; PET=polyethylene terephthalate (polyester), PTFE=polytetrafluoroethylene, PA=polyamide, PE=polyethylene, PU=polyurethane and PP=polypropylene. ZSV216 is the manufacture's designation of a tested sliding coating, and hard paper is a paper fiber reinforced phenolic resin. "Ceramic" denotes microscopic ceramic particles embedded into the EP matrix specified. "Cold" denotes application by means of a film rear side equipped in self-adhesive fashion, and "hot" denotes a hot lamination process in which the film rear side equipped with hot melt adhesive was connected to the carrier core by means of heating and pressing. The "carrier load" column specifies the weight loading of the carrier during the wear test. The weight loading of the semiconductor wafer was 9 kg for all cases.

TABLE 1

Carrier materials for wear test

| Carrier material | | | | | |
|---|---|---|---|---|---|
| | | Application | | | Carrier |
| Abbreviation | Type | Layer | Film | Solid mater. | load [kg] |
| a | EP-GFP | | | X | 2 |
| b | EP-GFP | | | X | 4 |
| c | PVC film | | X | | 2 |

TABLE 1-continued

Carrier materials for wear test

| Carrier material | | | | | |
|---|---|---|---|---|---|
| | | Application | | | Carrier |
| Abbreviation | Type | Layer | Film | Solid mater. | load [kg] |
| d | PVC film | | X | | 4 |
| e | PET (cold) | | X | | 2 |
| f | PET (hot) | | X | | 4 |
| g | EP-CFP | | | X | 4 |
| h | PP-GFP | | | X | 4 |
| i | PP-PPFP | | | X | 4 |
| j | Hard paper | | | X | 4 |
| k | PTFE II | X | | | 4 |
| l | PA film | | X | | 4 |
| m | PE (I) | X | | | 4 |
| n | PE (II) | X | | | 4 |
| o | PU | X | | | 4 |
| p | EP/ceramic | X | | | 4 |
| q | EP (primer) | X | | | 4 |
| r | Sliding coat. ZSV216 | X | | | 4 |

It is apparent that the various materials for the carrier, under the complex mixed loading consisting of grinding effect caused by the working layer and lapping effect caused by the grinding slurry on account of the material removal from the semiconductor wafer, yield extremely different wear rates for the carrier. The value for material i (PP fiber reinforced PP) could not be determined reliably (dashed line for measurement point and error bar in FIG. 18). The lowest wear rates are shown for example by PVC (c for 2 kg test load and d for 4 kg test load), PET (e for a thermoplastic self-adhesive film with 2 kg test load and f for a film of crystalline PET applied by means of a hot lamination method), PP (h) and PE (m for a very thin soft film of LD-PE and n for a thicker, harder film of LD-PE having a different molecular weight). A particularly low wear rate is obtained with an elastomer PU (o).

Figure 19:
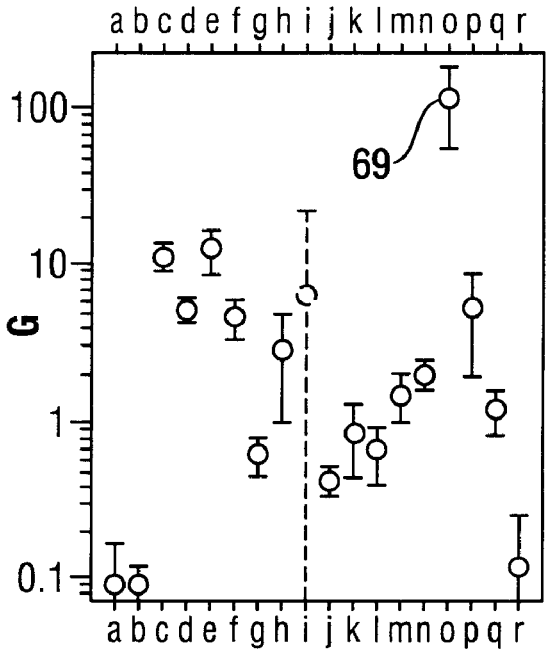
FIG. 19 shows the ratio of material removal from the semiconductor wafer and wear of the carrier in the "accelerated wear test" for various tested materials of the carriers.

FIG. 19 shows the ratio of material removal from the semiconductor wafer obtained during a test cycle and the measured wear of the carrier. This plotting directly incorporates the cutting capacity (sharpness) of the working layer, which was freshly dressed in each case before the beginning of the experiment. Some carrier materials rapidly make the working layer blunt, such that only a relatively low removal rate is obtained for the semiconductor wafer and the ratio of carrier wear and semiconductor wafer removal becomes even less favorable. Advantageously high values for the "G factor" (material-removing ratio) thus clarified are afforded by carriers composed of PVC (c and d), PET (e and j) and ceramic particle filled EP (p); however, the ratio determined for PU (o) is still more than a factor of ten higher than that of the above-mentioned materials.

Figure 20:
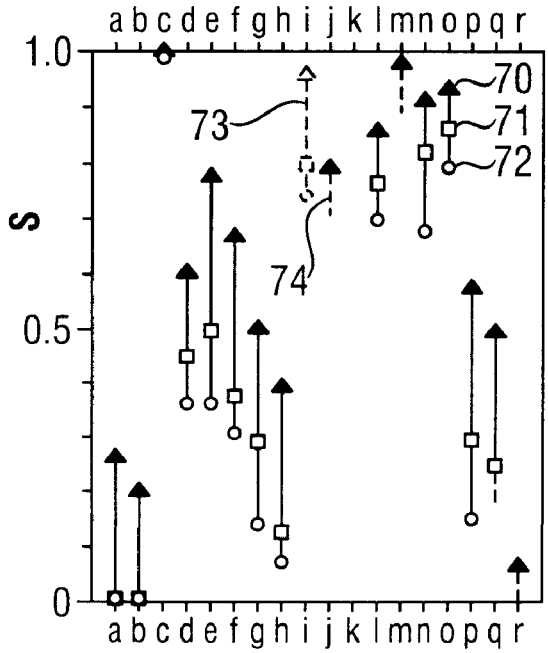
FIG. 20 shows the relative alteration of the cutting capacity of the working layer with the machining duration in the "accelerated wear test" for various tested materials of the carriers.

FIG. 20 shows the interaction of the abrasion of the carrier material with the working layer. The illustration shows the respective removal rates 73 obtained under the constant test conditions after a test duration of respectively 10 min (70), 30 min (71) and 60 min (72), relative to the average removal rates of the reference material c (PVC film with 2 kg test load). A decrease in the removal rate of the working layer over time is undesirable. Such a carrier rapidly makes the working layer blunt and would result in frequent redressing and unstable and uneconomic work sequences. For some carrier materials, the sharpness of the working layer decreases so rapidly that it is totally blunt at 30 min or 60 min, or the carrier composed of the material was so unstable that it was completely worn or broken after a few minutes (dashed lines 74), for example for Pertinax (a phenolic resin impregnated paper, generally referred to as "hard paper") j, PE film m or the tested EP primer coating q or the "wear protection coating" ZSV216 r. Carriers composed of the materials PA (1) and PE (n) proved to be advantageous with regard to low blunting of the sharpness of the working layer. However, an elastomeric PU (o) is particularly stable and exhibits a low blunting effect on the sharpness of the working layer.

Furthermore, FIG. 20 shows that carrier materials in which a fiber reinforced layer comes into contact with the working layer lead to particularly rapid blunting of the working layer: the grinding effect of the working layer has already decreased drastically after 10 min for example for EP-GFP (a and b), EP-CFP (g) and PP-GFP (h), and stops almost completely after a few more minutes. In comparison with glass fiber reinforced EP (a and b), a coating composed of EP without glass fibers (p) blunts the working layer significantly more slowly. Therefore, it is preferred for the first material to contain no glass fibers, no carbon fibers and no ceramic fibers.

For a first embodiment of this third method according to the invention (carrier with little interaction), use is made of a carrier which is completely composed of a first material or bears a full or partial coating composed of a first material such that only this layer comes into contact with the working layer during the machining, said first material having a high abrasion resistance.

Polyurethane (PU), polyethylene terephthalate (PET), silicone, rubber, polyvinyl chloride (PVC), polyethylene (PE), polypropylene (PP), polyamide (PA) and polyvinyl butyral (PVB), epoxy resin and phenolic resins are preferred for said first material. Furthermore, polycarbonate (PC), polymethyl methacrylate (PMMA), polyether ether ketone (PEK), polyoxymethylene/polyacetal (PON), polysulfone (PSU), polyphenylene sulfone (PPS) and polyethylene sulfone (PES) can also advantageously be used.

Polyurethanes in the form of thermoplastic elastomers (TPE-U) are particularly preferred. Likewise particularly preferred are silicones as silicone rubber (silicone elastomer), or silicone resin, furthermore rubber in the form of vulcanized rubber, butadiene-styrene rubber (SBR), acrylonitrile rubber (NBR), ethylene-propylene-diene rubber (EPDM), etc., and also fluororubber. Furthermore, particular preference is attached to PET as partly crystalline or amorphous polymer, in particular (co)polyester-based thermoplastic elastomer (TPE-E), and also polyamide, in particular PA66 and thermoplastic polyamide elastomer (TPE-A), and polyolefins such as PE or PP, in particular thermoplastic olefin elastomers (TPE-O). Finally, PVC, in particular plasticized (soft) PVC (PVC-P), is particularly preferred.

For coating or solid material, fiber reinforced plastics (FRP; compound plastics) are likewise preferred, the fiber reinforcement not comprising glass fibers, carbon fibers or ceramic fibers. Natural fibers and synthetic fibers, for example cotton, cellulose, etc., and polyolefins (PE, PP), aramides, etc. are particularly preferred for the fiber reinforcement.

Figure 21:
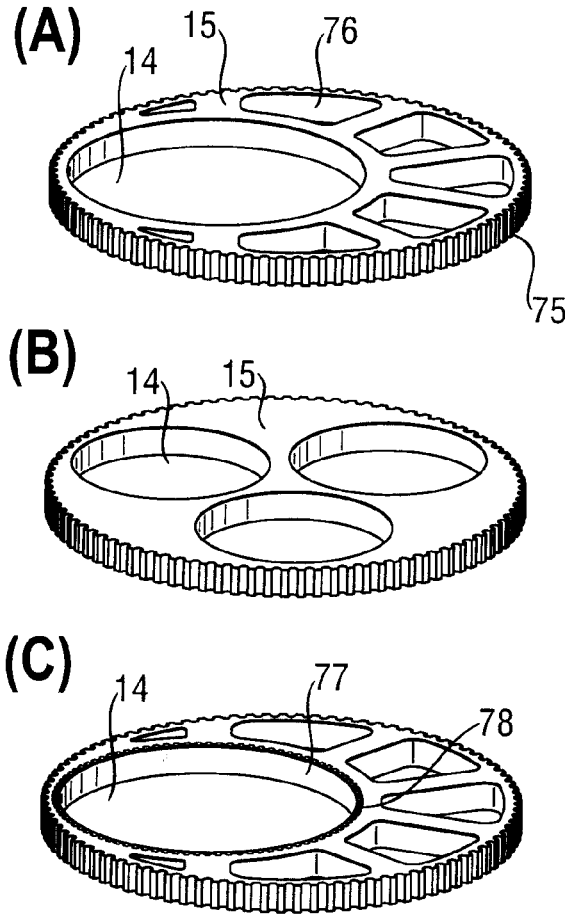
FIG. 21 shows exemplary embodiments of monolayer carriers (solid material) according to the invention.

Exemplary embodiments of carriers according to the invention are represented in the illustrations of FIG. 21 to FIG. 24. FIG. 21 shows carriers 15 which are completely composed of a first material (monolayer carriers). By way of example, FIG. 21(A) shows a carrier having one opening 14 for receiving one semiconductor wafer and FIG. 21(B) shows a carrier having a plurality of openings 14 for simultaneously receiving a plurality of semiconductor wafers. Alongside said receiving openings, the carriers comprise an outer toothing 75 which engages into the rolling apparatus—formed from inner and outer pinned wheels—of the machining machine, and optionally one or more perforations or openings 76 that primarily serve for the better through-flow and exchange of the cooling lubricant supplied to the working gap between front and rear sides (upper and lower working layers).

FIG. 21(C) shows a monolayer carrier according to the invention composed of a first material in a further exemplary embodiment, in which carrier the opening 14 for receiving the semiconductor wafer is lined with a third material 77. This additional lining 77 is preferred if the first material of the carrier 15 is very hard and, in direct contact with the semiconductor wafer, would lead to an increased risk of damage in the edge region of the semiconductor wafer. The third material of the lining 77 is then chosen to be softer, thereby precluding edge damage. The lining is connected to the carrier 15 for example by adhesive bonding or positive locking, if appropriate by means of a "dovetail" 78 enlarging the contact area, as shown in the exemplary embodiment in FIG. 21(C). Examples of suitable third materials 77 are disclosed in EP 0208315 B1.

It is likewise preferred if the carrier has a core—which does not come into contact with the working layer—composed of a material having higher stiffness (modulus of elasticity) than the coating that comes into contact with the working layer. Metals, in particular alloyed steels, in particular corrosion-protected (stainless steel) and/or spring steels, and fiber reinforced plastics are particularly preferred for the carrier core. In this case, the coating, that is to say the first material, is preferably composed of an unreinforced plastic. The coating is preferably applied to the core by deposition, dipping, spraying, flooding, warm or hot adhesive bonding, chemical adhesive bonding, sintering or positive locking. The coating may also be composed of individual points or strips which are inserted into matching holes in the core by joining or pressing, injection molding or adhesive bonding.

Figure 22:
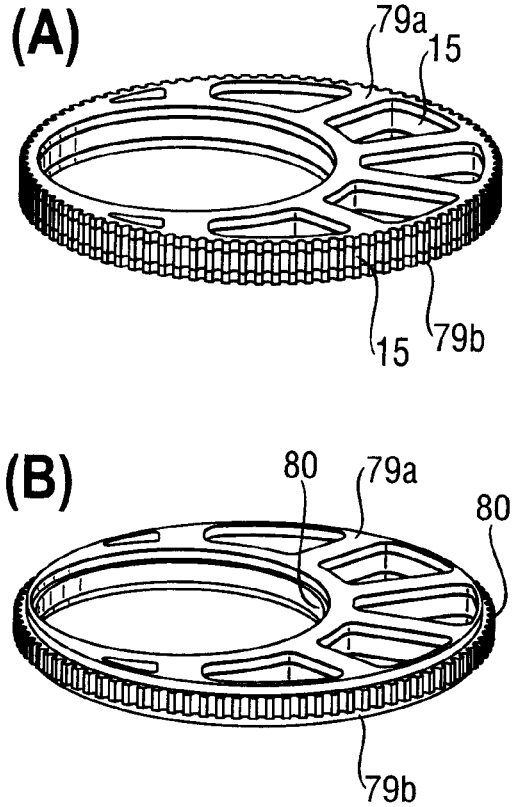
FIG. 22 shows exemplary embodiments of multilayer carriers according to the invention with full or partial coating.

Exemplary embodiments of such multilayer carriers, comprising a core 15 composed of the second material and a front-(79*a*) and rear-side coating 79*b* composed of the first material, are shown in FIG. 22. In this case, FIG. 22(A) describes a carrier in which the front and rear sides thereof are coated over the whole area of the core 15, while FIG. 22(B) describes a carrier which is coated over part of the area and in which, in the exemplary embodiment shown, by way of example a ring-shaped region 80 was left free at the opening for receiving the semiconductor wafer and at the outer toothing of the carrier.

Advantages of carriers coated over part of the area according to the example in FIG. 22(B) include the fact that e.g. the edge of the opening for receiving the semiconductor wafer can be provided with a lining composed of a third material 77 as in FIG. 21(C), which lining is only connected to the harder second material of the core 15 and can optionally be applied before or after the coating, or that e.g. the region of the outer toothing is kept free of the low-wear first material and, as a result, disturbing material abrasion is avoided in the course of rolling in the rolling apparatus of the machining machine.

A fiber reinforcement composed of stiff fibers, for example glass or carbon fibers, in particular ultrahigh modulus carbon fibers, is preferred for the plastics of a core which does not come into contact with the working layer.

The coating is particularly preferably applied in the form of a prefabricated film by means of lamination in a continuous method (roll lamination). In this case, the film is coated on the rear side with a cold-bonding adhesive or, more preferably, with a warm or hot melt adhesive (hot lamination), comprising base polymers TPE-U, PA, TPE-A, PE, TPE-E or ethylene vinyl acetate (EVAc) or the like.

Furthermore, it is preferred for the carrier to comprise a stiff core and individual spacers, the spacers being composed of an abrasion-resistant material having low sliding resistance and being arranged in such a way that the core does not come into contact with the working layer during the machining.

Figure 23:
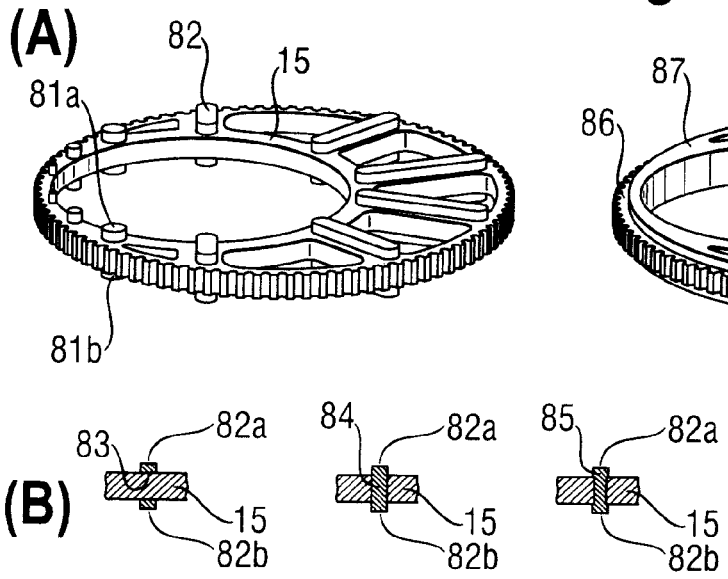
FIG. 23 shows exemplary embodiments of carriers according to the invention with partial-area coating in the form of one or more "knobs" or elongate "bars".

Exemplary embodiments of carriers having spacers of this type are represented in FIG. 23. The spacers can be for example "knobs" or "points" 81 or elongate "bars" 82 applied on the front side (81*a*) and rear side (81*b*) and having in each case any desired form and in any desired number (FIG. 23(A)). These spacers 82*a* (front side of the carrier) and 82*b* (rear side) can for example be connected to the carrier 15 (FIG. 23(B)) by adhesive bonding, e.g. by means of a rear-side self-adhesive coating 83 of the individual coating elements 82 (and 81), or be fitted (84) in a positive locking manner in holes in the carrier or be elements 85 that lead through holes in the carrier and are widened (pressed, etc.) on the front and rear sides of the carrier in, for example, mushroom-shaped fashion by calking, riveting, melting, etc. Moreover, a front-side (79*a*) and rear-side (79*b*) coating in accordance with the exemplary embodiments in FIG. 22 can be connected to one another by means of a plurality of webs running through holes in the carrier in accordance with the example of the coating elements 84 and 85, respectively, in FIG. 23(B) and can thereby afford an additional safeguard against undesirable detachment of the applied coating 79.

Finally, it is preferred for the core composed of the second material to be composed exclusively of a thin outer ring-shaped frame of the carrier, this ring comprising the toothing of the carrier for the drive by the rolling apparatus. An inlay composed of the first material comprises one or a plurality of cutouts for a respective semiconductor wafer. Preferably, the first material is connected to the ring-shaped frame by positive locking, adhesive bonding or injection molding. The frame is preferably substantially stiffer and exhibits substantially less wear than the inlay. During the machining, preferably only the inlay comes into contact with the working layer. A steel frame with an inlay composed of PU, PA, PET, PE, PU-UHWM, PBT, POM, PEEK or PPS is particularly preferred.

Figure 24:
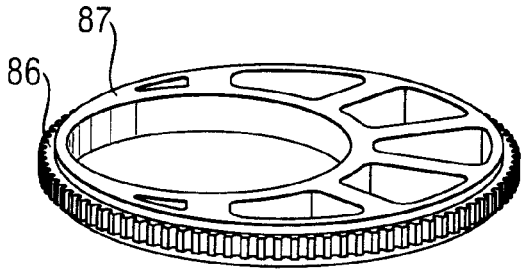
FIG. 24 shows an exemplary embodiment of a carrier according to the invention, comprising a toothed outer ring and an insert.

As illustrated in FIG. 24, it is preferred for the ring-shaped frame 86 with the toothing to be thinner than the inlay 87 and be connected to the inlay 87 substantially centrally with respect to the thickness of said inlay, in order that the frame composed of the second material does not come into contact with the working layers of the machining apparatus. The connection location between inlay 87 and frame 86 is preferably embodied in blunt fashion, as shown in the case of the spacer 84 press-fitted in positively locking fashion in FIG. 23(B), or consists in a widening of the inlay 87 beyond the edge of the frame 86 according to the example of the spacer 85 in FIG. 23(B).

It is particularly preferred if the above spacers that are subject to wear as a result of contact with the working layer can be easily replaced by joining in holes in the core or by adhesive bonding onto the surface of the core.

It is likewise particularly preferably the case that the worn partial- or whole-area coating can easily be stripped from the core and be renewed by the application of a new coating. In the case of suitable substances, the stripping is effected the most simply by means of suitable solvents (for example PVC by tetrahydrofuran, THF), acids (for example PET or PA by formic acid) or by heating in an oxygen-rich atmosphere (incineration).

In the case of a core composed of an expensive material, for example stainless steel, or metal which is calibrated to thickness in a complicated manner by material removal (grinding, lapping, polishing) and is heat-treated or aftertreated in some other way or coated, such as steel, aluminum, titanium or alloys thereof, high-performance plastic (PEEK, PPS, POM, PSU, PES or the like, if appropriate with an additional fiber reinforcement), etc., it is preferred to reuse the carrier after extensive wear of the coating by repeated reapplication of the wear coating. Particularly preferably, in this case the coating is applied congruently by means of lamination in the form of a film which has previously been cut to the dimensions of the carrier in accurately fitting fashion by means of stamping, cutting plotters or the like, such that no rework such as trimming of possibly projecting parts of the coating, edge trimming, deburring, etc. is necessary. Most preferably, a residue of the worn first coating can also remain here in the case of a core composed of high-performance plastic.

In the case of a core composed of an inexpensive material, for example a possibly additionally fiber reinforced plastic such as EP, PU, PA, PET, PE, PBT, PVB or the like, a single coating is preferred. In this case, the coating is most preferably already effected on the blank (slab) for the core, and the carrier is only separated from the "sandwich" slab—formed from rear-side coating, core and front-side coating—by means of milling, cutting, water jet cutting, laser cutting or the like. After the coating has worn down almost to the core, the carrier is then discarded in this exemplary embodiment.

Figure 11:
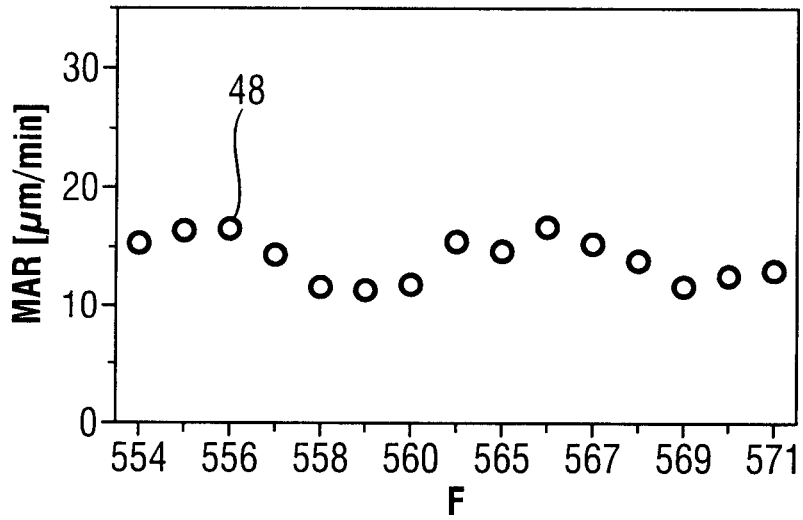
FIG. 11 shows the average rates of the material removal from semiconductor wafers during successive machining runs with a method according to the invention, in which carriers according to the invention were used.

FIG. 11 represents, as an example, the average removal rate MAR of the semiconductor wafer that was obtained for successive machining passes F, wherein a carrier which, according to the invention, did not influence the sharpness of the working layer was used. The average removal rate remains substantially constant (48) over the 15 machining cycles shown here. The material removal from the semiconductor wafer during a machining cycle was 90 μm. The carrier comprised a stainless steel core provided with a 100 μm thick PVC coating on the front and rear sides. The decrease in thickness of this coating on account of wear was on average 3 μm per machining cycle.

Figure 12:
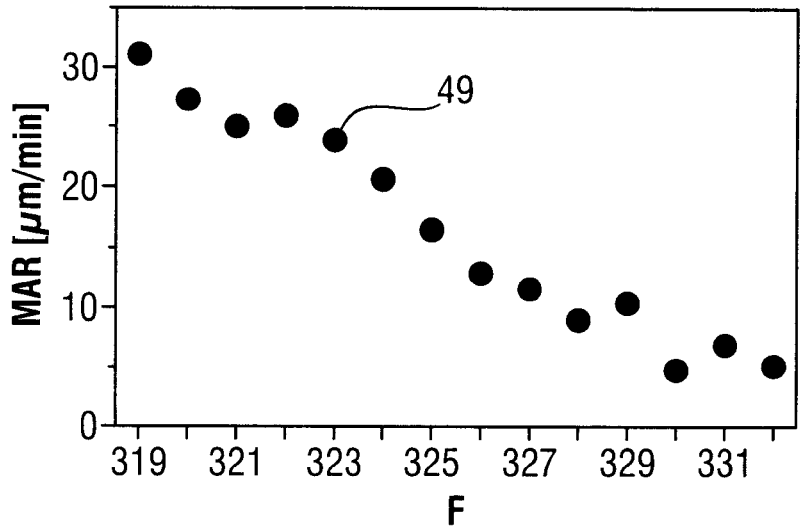
FIG. 12 shows the average removal rates from successive machining runs with a method not according to the invention, in which carriers not according to the invention were used.

FIG. 12 represents, as a comparative example, the average removal rate MAR of the semiconductor wafer that was obtained for successive machining passes F, wherein a carrier not according to the invention was used, which had a reducing effect on the sharpness of the working layer. The average removal rate decreases continuously from machining cycle to machining cycle from initially more than 30 μm/min to less than 5 μm/min within the 14 machining cycles shown. The carrier was composed of glass fiber reinforced epoxy resin. The decrease in thickness of this coating on account of wear was on average 3 μm per machining cycle.

For a second embodiment of the third method according to the invention ("dressing carrier"), use is made of a carrier which is completely composed of a second material or as a coating of the parts which come into contact with the working layer composed of a second material, said second material containing substances which dress the working layer.

It is preferred for said second material to contain hard substances and to be subject to wear upon contact with the working layer, such that hard substances that dress the working layer are released as a result of the wear. It is particularly preferred for the hard substances released in the course of the wear of the second material to be softer than the abrasive contained in the working layer. It is particularly preferred for the released material to be corundum ($Al_2O_3$), silicon carbide (SiC), zirconium oxide ($ZrO_2$), silicon dioxide ($SiO_2$) or cerium oxide ($CeO_2$) and for the abrasive contained in the working layer to be diamond. Most preferably, the hard substances released from the first material of the carrier are so soft ($SiO_2$, $CeO_2$), or their grain size is so small ($Al_2O_3$, SiC, $ZrO_2$), that they do not increase the roughness and damage depth of the semiconductor wafer surface, which is determined by the machining by the abrasives from the working layer.

In general, the degree of interaction between carrier and working layer is different for the two working layers. This is due for example to the inherent weight of the carrier, which leads to an increased interaction with the lower working layer, or the distribution of the operating agent (cooling lubrication) which is supplied to the working gap and which produces a different cooling lubricant film on the top side and underside. Particularly in the case of a carrier which is not according to the invention and which reduces the sharpness of the working layer, the result is a highly asymmetrical blunting between upper and lower working layers. This brings about a different removal from the front and rear sides of the semiconductor wafer, and an undesirable roughness-induced deformation of the semiconductor wafer occurs.

Figure 13:
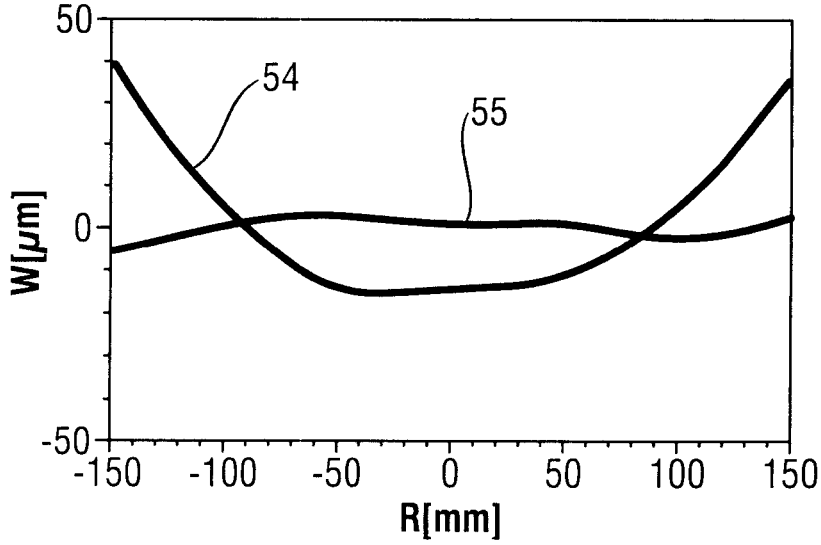
FIG. 13 shows the warp of a semiconductor wafer which was machined by a method according to the invention, in comparison with a semiconductor wafer which was machined by a method not according to the invention.

FIG. 13 shows, as an example, the warp W of a semiconductor wafer (55) machined with a carrier that is according to the invention and is composed of PVC, and, as a comparative example, the warp of a semiconductor wafer (54) machined with a carrier that is not according to the invention. The carrier that is not according to the invention is composed of stainless steel in the example shown. Carbon of the diamond of the working layer is released in the stainless steel, the diamond becomes brittle and the working layer becomes blunt. Due to the weight of the carrier, the interaction of the carrier with the lower working layer is greater than the interaction with the upper working layer, such that the lower working layer becomes blunt more rapidly. This results in a material removal from the semiconductor wafer that is highly asymmetrical between underside and top side, with greatly different front and rear side roughnesses. A warp forms (strain-induced warpage). The warp is plotted against the radial measurement position R on the semiconductor wafer. The warp W denotes the maximum of the flexure of a semiconductor wafer mounted without any forces on account of deformation or strain over its entire diameter. The warp of the semiconductor wafer machined according to the invention is 7 μm, and that of the semiconductor wafer not machined according to the invention is 56 μm.

Figure 14:
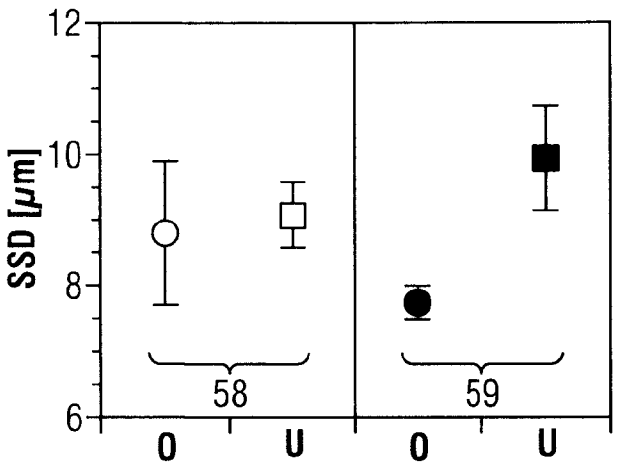
FIG. 14 shows the surface damage depth ("sub-surface damage", SSD) of front and rear sides of a semiconductor wafer which were machined by a method according to the invention with identical material removal by the two working layers of the apparatus, in comparison with a wafer with unequal material removal that was not machined according to the invention.

FIG. 14 shows, as an example, the damage depths (subsurface damage, SSD) of the underside (U) and top side (O) of a semiconductor wafer (58) machined with a carrier according to the invention (PVC film, laminated onto a core composed of stainless steel) and, as a comparative example, those of a semiconductor wafer (59) machined with a carrier not according to the invention (glass fiber reinforced epoxy resin). In the case of the semiconductor wafer 58 machined according to the invention, the SSD is identical for both sides within the scope of the measuring error. In the case of the semiconductor wafer 59 not machined according to the invention, the SSD of the side O machined by the upper working layer is significantly lower and the SSD of the side U machined by the lower working layer is significantly higher than that obtained for both sides of the semiconductor wafer machined according to the invention. The SSD was determined by a laser-acoustic measuring method (measurement of the sound dispersion after laser pulse excitation).

Figure 15:
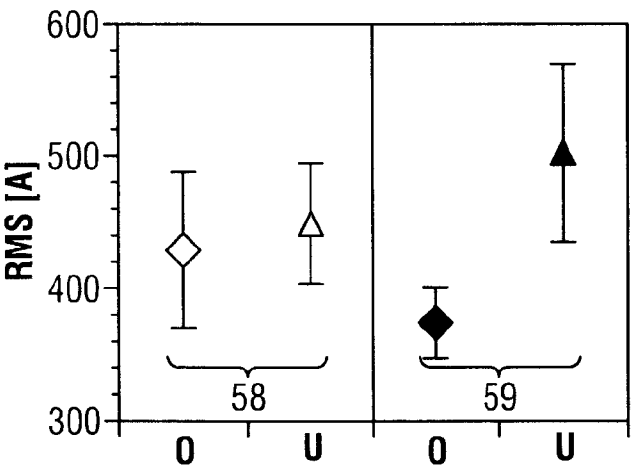
FIG. 15 shows the surface roughness of front and rear sides of a semiconductor wafer which were machined by a method according to the invention with identical material removal by the two working layers of the apparatus, in comparison with a wafer with unequal material removal that was not machined according to the invention.

FIG. 15 shows, as an example, the RMS roughnesses RMS of the top side (O) and underside (U) of a semiconductor wafer (58) machined with a carrier according to the invention (PVC on stainless steel) and, as a comparative example, those of a semiconductor wafer (59) machined with a carrier not according to the invention (glass fiber reinforced epoxide). In the case of the semiconductor wafer (58) machined according to the invention, the roughness is identical for both sides within the scope of the measuring error. In the case of the semiconductor wafer 59 not machined according to the invention, the roughness of the side O machined by the upper working layer is significantly lower and the roughness of the side U machined by the lower working layer is significantly higher than that obtained for both sides of the semiconductor wafer machined according to the invention. (RMS=root mean square, RMS value of the roughness amplitudes.) The roughness was determined using a stylus profilometer (80 μm filter length).

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for the simultaneous double-side grinding of a plurality of semiconductor wafers, comprising positioning each one of the plurality of wafers such that it is freely moveable in a cutout of one of a respective plurality of carriers caused to rotate by means of a rolling apparatus and is thereby moved on a cycloidal trajectory, wherein the semiconductor wafers are machined in material-removing fashion between two rotating ring-shaped working disks, each working disk having an outer edge and an inner edge and comprising at its surface a working layer containing bonded abrasive and having an inner circumference and an outer circumference, the surfaces of the working layers defining a working gap between them, wherein the location-dependent width of the working gap is determined during machining, and the shape of at least one working disk is altered thermally by changing the temperature or the volumetric flow rate or both of a cooling lubricant introduced into the working gap during machining, depending on the measured location-dependent width of the working gap such that the magnitude of the ratio of the difference between the maximum and minimum widths of the working gap to the width of the working disks, during at least the last 10% of material removal, is at most 50 ppm.

2. The method of claim 1, wherein the magnitude of the ratio of the difference between the maximum and minimum widths of the working gap to the width of the working disks, during all of the material removal, is at most 50 ppm.

3. The method of claim 1, wherein the ratio of the difference between the widths of the working gap at the outer edge and at the inner edge to the width of the working disks is between 0 and +50 ppm.

4. The method of claim 1, wherein the location-dependent width of the working gap is determined by measuring its width during machining at at least two points by means of contactless distance measuring sensors in at least one working disk with at least one distance measuring sensor near the inner edge and at least one distance measuring sensor near the outer edge of the working disk.

5. The method of claim 1, wherein, during grinding, the temperature in the working gap is measured at at least two points, and wherein, by comparing the measured temperature profile in the working gap with temperature profiles measured before the beginning of grinding and the location-dependent widths of the working gap that have been respectively measured for the temperature profiles, the location-dependent width of the working gap is determined during machining.

6. The method of claim 4, wherein during grinding the temperature in the working gap is measured at at least two points, and by comparing the temperature profile measured in the working gap with temperature profiles measured before the beginning of machining and the location-dependent widths of the working gap associated therewith, a prediction of the change in location-dependent width of the working gap is made and said prediction is used for one control of the form of the working gap, and wherein use is made of the measurement of the width of the working gap at at least two points for monitoring the actual location-dependent width of the working gap and for the compensation of a possible drift of the location-dependent width of the working gap for a second control.

7. The method of claim 6, wherein at least one of the working disks contains an apparatus for changing the temperature of said working disk, and wherein the location-dependent width of the working gap is controlled in a control loop, wherein the difference between the widths of the working gap at the inner and outer edges of the working disk constitute a controlled variable, the temperature of the working disk constitutes a manipulated variable, and the temperatures measured in the working gap constitute disturbance variables, and wherein the temperature of the working disk is influenced by means of the temperature or the volumetric flow rate of a cooling lubricant introduced into the working gap during machining.

8. The method of claim 1, wherein part of the area of the semiconductor wafers, during machining, temporarily leave the working gap delimited by the inner and outer circumferences of the working layers, wherein the maximum of overrun in a radial direction is more than 0% and at most 20% of the diameter of the semiconductor wafer, wherein the overrun is defined as the length measured in a radial direction relative to the working layers by which a semiconductor wafer projects beyond the inner circumference or outer circumference of the working layer at a specific point in time during grinding.

9. The method of claim 8, wherein the semiconductor wafers, when temporarily leaving the working gap over part of the surface area of the wafers, gradually sweep over an entire circumference of the working layers completely and repetitively.

10. The method of claim 8, wherein the semiconductor wafers leave the working gap temporarily by extending past the inner circumference and also temporarily extending past the outer circumference of the working layer.

11. The method of claim 1, wherein the carrier is completely composed of a first material, or the carrier is composed of a core of a second material and the second material is completely or partly coated with a first material such that during grinding, only the first material comes into mechanical contact with the working layer and the first material does not interact with the bonded abrasive of the working layer to reduce the sharpness of the abrasive.

12. The method of claim 11, wherein the first material has a high abrasion resistance.

13. The method of claim 11, wherein the first material contains no glass fibers, no carbon fibers and no ceramic fibers.

14. The method of claim 11, wherein the first material comprises one or more of the following substances: polyurethane (PU), polyethylene terephthalate (PF), silicone, rubber, polyvinyl chloride (PVC), polyethylene (PE), polypropylene (PP), polyamide (PA), polyvinyl butyral (PEP), epoxy resin, phenolic resin, polycarbonate (PC), polymethyl methacrylate (PMMA), polyether ether ketone (PEK), polyoxymethylene/polyacetal (PON), polysulfone (PSU), polyphenylene sulfone (PPS) and polyethylene sulfone (PES).

15. The method of claim 11, wherein the first material contains one or more of the following substances: polyurethane in the form of a thermoplastic elastomer (TPE-U), silicone rubber, silicone resin, vulcanized rubber, butadiene-styrene rubber (SBR), acrylonitrile rubber (NBR), ethylene-propylene-diene rubber (EPDN), fluororubber, partly crystalline or amorphous polyethylene terephthalate (PEP), polyester-based or copolyester-based thermoplastic elastomer (TPE-E), polyamide, polyolefins and polyvinyl chloride (PVC).

16. The method of claim 11, wherein the carriers have a coating composed of the first material and a core composed of the second material, wherein the second material has a higher modulus of elasticity than the first material.

17. The method of claim 16, wherein the second material comprises a metal.

18. The method of claim 17, wherein the second material is a steel.

19. The method of claim 16, wherein the second material comprises an optionally reinforced plastic.

20. The method of claim 16, wherein the coating is applied to the core by deposition, dipping, spraying, flooding, warm or hot adhesive bonding, chemical adhesive bonding, sintering or positive locking.

21. The method of claim 11, wherein the first material comprises a plurality of individual pieces, and wherein said pieces are inserted into matching holes in the core by joining, pressing, injection molding or adhesive bonding.

22. The method of claim 11, wherein the first material is stripped from the core after wear and a new first material is applied to the core, to form a renewed carrier, and, the renewed carrier is reused.

23. The method of claim 16, wherein the coating is stripped from the core after wear and a new coating of first material is applied to the core, to form a renewed carrier and, the renewed carrier is reused.

24. The method of claim 16, wherein the core composed of the second material is composed exclusively of a thin outer ring of the carrier, wherein said ring comprises toothing for drive by a rolling apparatus, wherein the first material is connected to said core by positive locking, adhesive bonding or injection molding, and wherein the first material has one or more cutouts to receive a semiconductor wafer.

25. The method of claim 11, wherein the first material brings about a dressing of the abrasive in the working layer.

26. The method of claim 25, wherein dressing is effected by the release of hard substances from the first material of the carrier.

27. The method of claim 26, wherein the hard substances released from the first material of the carrier are softer than the abrasive of the working layer.

28. The method of claim 27, wherein at least one released hard substance is selected from the group consisting of corundum ($Al_2O_3$), silicon carbide (SiC), cerium oxide ($C_eO_2$) and zirconium oxide ($ZrO_2$) and the abrasive of the working layer contains diamond.

29. The method of claim 26, wherein the hard substances released from the first material of the carrier are of a degree of softness, or their grain size is so small, that they do not increase the roughness and damage depth of the surface of the semiconductor wafer determined by machining by the abrasive from the working layer.

* * * * *